US006412992B2

(12) United States Patent
Mogi

(10) Patent No.: US 6,412,992 B2
(45) Date of Patent: Jul. 2, 2002

(54) PRINTER WITH PAPER ALIGNING DEVICE

(75) Inventor: Shusuke Mogi, Saitama (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/758,123

(22) Filed: Jan. 12, 2001

(30) Foreign Application Priority Data

Jan. 14, 2000 (JP) ..... 2000-005486

(51) Int. Cl.[7] ..... B41J 15/04; B41J 15/16; B65H 23/035

(52) U.S. Cl. ..... 400/579; 400/613; 400/614; 400/618; 400/619; 400/633

(58) Field of Search ..... 400/613, 579, 400/614, 618, 619, 633, 633.1, 633.2

(56) References Cited

U.S. PATENT DOCUMENTS 6,262,752 B1 * 7/2001 Suzuki et al. ..... 346/134
6,296,248 B1 * 10/2001 Tanaka ..... 271/198

FOREIGN PATENT DOCUMENTS

JP 62-13248 3/1987 ..... B65H/9/10
JP 8-143183 6/1996 ..... B65H/9/00
JP 8-157120 6/1996 ..... B65H/23/188
JP 10-29356 2/1998 ..... B41J/15/04
JP 10194539 A * 7/1998 ..... G11B/07/125

OTHER PUBLICATIONS

Patent abstracts of Japan 10–029356, Feb. 3, 1998.
Patent abstracts of Japan 08–143183, Jun. 4, 1996.
Patent abstracts of Japan 60137743 A, Jul. 22, 1985 (62–13248).
Patent abstracts of Japan 08–157120, Jun. 18, 1996.

* cited by examiner

*Primary Examiner*—Daniel J. Colilla
(74) *Attorney, Agent, or Firm*—Sughrue Mion, PLLC

(57) ABSTRACT

An aligning device is provided in a paper transport path in a printer, for correcting a recording paper to be parallel to the paper transport path. The aligning device has a pair of guide members (17, 18) that are shifted in a lateral direction to the paper transport path by a drive mechanism (21), to push side edges of the recording paper, and a stopping plate (19) for stopping the guide members at an aligning position. The drive mechanism is constituted of a cam shaft (28) rotated by an aligning motor, a pair of swing levers (29, 30) for converting rotational movement of the cam shaft into swinging movement, and a pair of sliding levers (31, 32) that slide in the lateral direction with the swinging movement of the swing levers. The guide members are mounted on pivot pins **(31*d*, 32*d*)** of the sliding levers, so the guide members may incline relative to the parallel direction to the paper transport path.

14 Claims, 16 Drawing Sheets

PRINTER WITH PAPER ALIGNING DEVICE

BACKGROUND OF THE INVENTION

1. Field of the Invention

The present invention relates to a printer with a paper aligning device for aligning a recording paper with a paper transport path in the printer.

2. Background Arts

As disclosed in Japanese Laid-open Patent Application No. 10-29356, a recording paper roll has been used in many kinds of printers. The recording paper roll is formed by winding a continuous web of recording paper around a cylindrical spool. The recording paper roll is held by a paper holder when it is set in a paper supply section of a printer, or in a paper magazine that is loaded in a magazine chamber of a printer. Then, the recording paper is fed out from the paper supply section or the paper magazine into a printing stage of the thermosensitive color printer. While the thermosensitive color printer is turned off or in a standby condition, the recording paper is rewound onto the roll, for protecting it from moisture.

As is well-known in the art, the recording paper supplied from the roll can be skewed relative to a paper transport path of the thermosensitive color printer, or a center line of the supplied recording paper can deviate from a center line of the paper transport path. If the recording paper is skewed or its center deviates, side edges of the recording paper may be bent or folded, or the recording paper may be jammed during the rewinding. To avoid such troubles, aligning devices for correcting the skewed or center-deviated recording paper have been developed.

An exemplary paper aligning device is disclosed in Japanese Laid-open Patent Application No. 8-143183, wherein a leading edge of the recording paper is pressed against a pair of feed rollers for correcting the skewed recording paper. At the same time, guide members are pressed onto opposite side edges of the recording paper for aligning the center of the recording paper with the center of the paper transport path.

Another type of paper aligning device is disclosed in Japanese Patent Publication No. 62-13248, wherein a stationary guide member is disposed on one lateral side of the paper transport path, and a movable guide member is disposed on the other lateral side of the paper transport path. The movable guide member is moved in a perpendicular direction to the transport path, to push one side edge of the conveyed recording paper such that the other side edge of the recording paper is pressed against the stationary guide member. Thereby the recording paper is aligned with the paper transport path.

In a printer using a recording paper roll, the aligning device is set at a retracted position away from the recording paper while a plurality of images are successively printed on the recording paper. This is for preventing damaging the side edges of the recording paper, especially for preventing damaging adhesive portions of such recording paper that is used for producing stickers. As a result, the recording paper tends to be skewed or deviated from the center during the successive printing.

Japanese Laid-open Patent Application No. 8-157120 discloses a teaching to apply a constant tension to the recording paper roll by a pair of paper holders that are attached to the opposite end faces of the recording paper roll. The tension improves stability in conveying the recording paper, so the recording paper is prevented from skewing or deviating from the center during successive printing. In this prior art, correction for the skewed or center-deviated recording paper is also executed immediately after the recording paper is set in the thermosensitive color printer, by making a plurality of times of precutting processes, whereby a leading end portion of the recording paper is cut off.

However, any of these conventional types of paper aligning devices involves a problem in that the recording paper sometimes cannot be aligned because it is resiliently bent by the pressure from the guide members. This problem is apt to occur in those printers which use different kinds of recording paper with different rigidity and stiffness, and those using such a recording paper roll that needs a large pressure for aligning. The conventional aligning devices also have a problem in that the recording paper is skewed again even after it is aligned, because of torsion of the recording paper that is provided between the recording paper roll and the aligning device by the aligning of the skewed paper itself.

Furthermore, since the recording paper is cut off the roll at the end of printing, if the cutting line is not rectangular to the side edges of the recording paper, the aligning device disclosed in Japanese Laid-open Patent Application No. 8-157120 cannot properly align the recording paper.

In the aligning device disclosed in Japanese Patent Publication No. 62-13248, because the movable guide member pushes the side edge of the skewed recording paper while maintaining the skewed condition, the other side edge of the recording paper comes to contact with the stationary guide member first at a point, so the side edge can sometimes be bent or folded at the contact point.

On the other hand, executing the precutting process a plurality of times, like in the prior art disclosed in Japanese Laid-open Patent Application No. 8-157120, elongates the total printing time and also consumes more recording paper.

SUMMARY OF THE INVENTION

An object of the present invention is to provide a printer with a paper aligning device that solves the above problems and aligns the recording paper with reliability.

According to the present invention, in a printer comprising a paper supply section for supplying a recording paper therefrom; a feed roller pair for nipping and conveying the recording paper along a paper transport path; a printing head for printing an image on the recording paper in synchronism with conveying movement of the recording paper; and an aligning device disposed in the paper transport path between the paper supply section and the printing head, for aligning the recording paper with the paper transport path, the aligning device comprises a pair of guide members placed so as to face side edges of the recording paper on the paper transport path so as to be able to pivot each on a perpendicular axis to a recording surface of the recording paper; a drive mechanism for shifting the guide members toward the side edges of the recording paper to push the side edges; and a stopping device for stopping the guide members at an aligning position as the guide members are shifted toward the side edges of the recording paper, wherein the recording paper is oriented parallel to the paper transport path as the side edges are confined by the guide members at the aligning position.

Since the guide members can pivot on the perpendicular axis to the recording surface of the recording paper, the guide members may be inclined relative to the parallel direction to the paper transport path, so the guide member may not push the side edge at a point even while the recording paper is skewed relative to the parallel direction to the paper transport path. Accordingly, the recording paper is prevented from being bent or folded by the guide members.

According to a preferred embodiment, the stopping device has a pair of stopping portions which the guide members come to contact with at the aligning position. By adjusting the position of the stopping portions in the lateral direction of the paper transport path and their angle relative to the parallel direction of the paper transport path, it is possible to determine the aligning position such that a center line of the recording paper is aligned with a center line of the paper transport path when the side edges are confined by the guide members at the aligning position.

By defining the distance between the stopping portions to be equal to a tolerable minimum width of the recording paper, the recording paper is aligned without fail even where there are variations in the width.

The paper transport path is preferably curved in a section passing through the aligning device. Thereby, the rigidity and stiffness of the recording paper is increased in the aligning device, reducing the risk of bending the recording paper by the pressure from the guide members.

It is preferable to provide a pair of position keeping rollers in the aligning device, so as to keep the recording paper in the aligned condition.

By applying tension to the recording paper appropriately in either conveying direction, the recording paper is prevented from being skewed or deviating from the center of the paper transport path, even while the recording paper is conveyed back and forth a number of times along the paper transport path.

BRIEF DESCRIPTION OF THE DRAWINGS

The above and other objects and advantages of the present invention will become apparent from the following detailed description of the preferred embodiments when read in association with the accompanying drawings, which are given by way of illustration only and thus are not limiting the present invention. In the drawings, like reference numerals designate like or corresponding parts throughout the several views, and wherein.

DETAILED DESCRIPTION OF THE EMBODIMENTS

Figure 1:
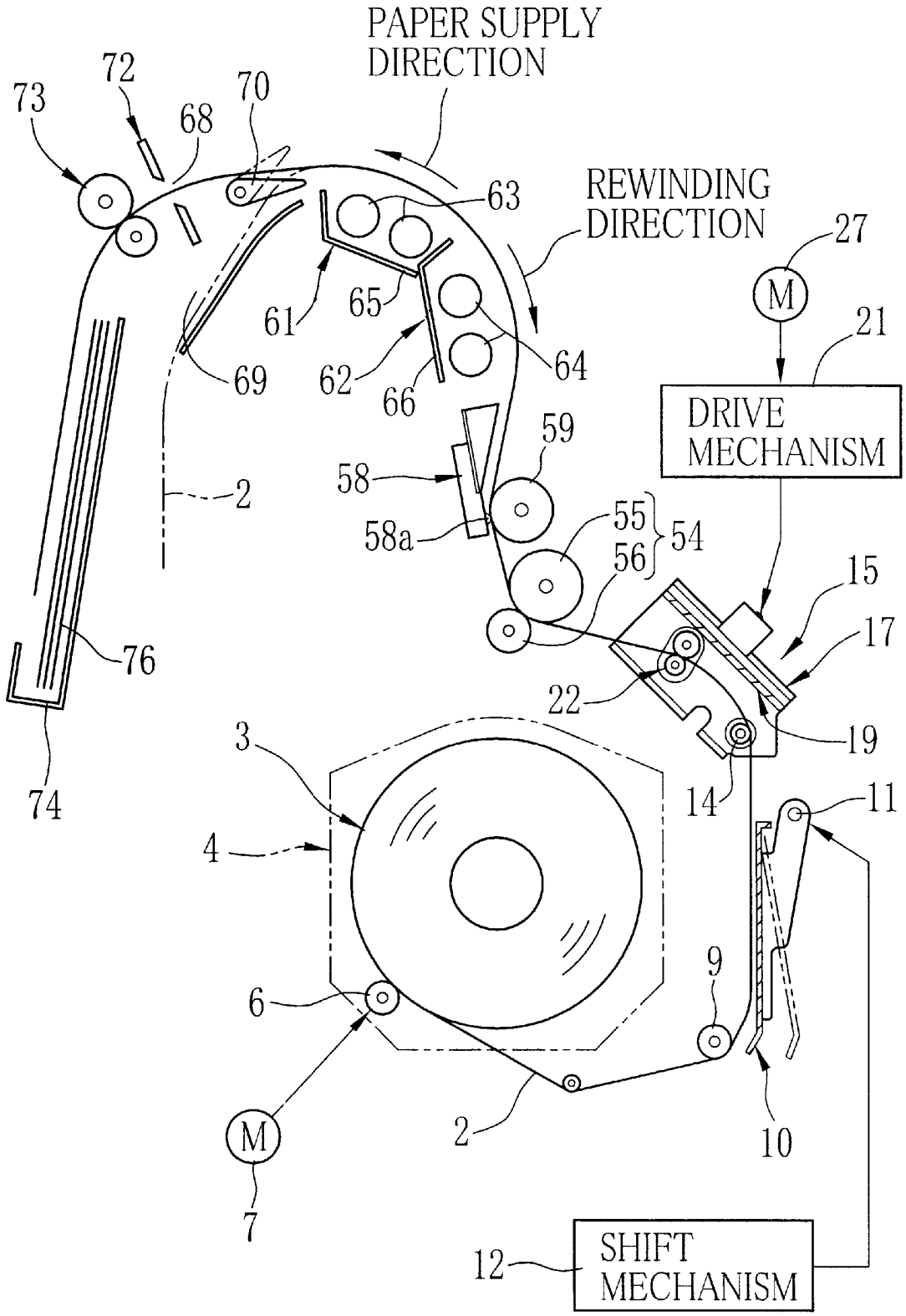
FIG. 1 is a schematic diagram illustrating a thermosensitive color printer according to an embodiment of the present invention.

In the embodiment shown in FIG. 1, the thermosensitive color printer uses a continuous web of thermosensitive color recording paper 2 that is coiled into a roll 3. The thermosensitive color recording paper 2 has a thermosensitive cyan coloring layer, a thermosensitive magenta coloring layer, a thermosensitive yellow coloring layer and a protection layer formed atop another on a base material in this order from the base material. The uppermost yellow coloring layer has the highest thermal sensitivity, so it needs the smallest heat energy for coloring. The bottommost cyan coloring layer has the lowest thermal sensitivity, so it needs the largest heat energy for coloring. The yellow coloring layer loses its coloring ability when exposed to near-ultraviolet rays of 420 nm. The magenta coloring layer has an intermediate thermal sensitivity, and loses its coloring ability when exposed to ultraviolet rays of 365 nm. The thermosensitive color recording paper 2 may have a fourth thermosensitive coloring layer, e.g. a black coloring layer.

The recording paper roll 3 is contained in a light-tight box or bag for sale on the market. After being removed from the box or bag, the recording paper roll 3 is placed in a paper magazine 4, and the paper magazine 4 is removably placed in a not-shown paper supply chamber of the thermosensitive color printer. A paper supply roller 6 is mounted in the paper magazine 4 so as to be kept in contact with an outer periphery of the paper roll 3. Although it is not shown in the drawings, a coupling gear is mounted coaxially with the paper supply roller 6 and is located outside the paper magazine 4. When the paper magazine 4 is placed in the paper supply chamber, the coupling gear is interlocked with a drive gear that is not shown but mounted in the paper supply chamber. The drive gear is driven by a feed motor 7 to rotate the paper supply roller 6 in a paper supply direction for feeding out the thermosensitive color recording paper 2 from the paper magazine 4, or in a rewinding direction for rewinding the thermosensitive color recording paper 2 into the paper magazine 4. In this embodiment, an image is thermally recorded on the thermosensitive color recording paper 2 as it is conveyed in the rewinding direction, so the rewinding direction is equal to a printing direction.

The thermosensitive color recording paper 2 is fed out from the paper magazine 4 into a paper transport path of the thermosensitive color printer. The thermosensitive color recording paper 2 is first turned around a first guide roller 9 into a vertical path section of the paper transport path, where a path size switching plate 10 is provided. As shown in detail in FIG. 2, the path size switching plate 10 may swing about a pair of bearings 11 between a limiting position as shown by solid lines in FIG. 1 and a widening position as shown by phantom lines in FIG. 1, by actuating a shift mechanism 12, that may be constituted of a solenoid, a cam mechanism or the like. While the path size switching plate 10 is in the widening position, the vertical transport path section is widened in a direction of thickness of the thermosensitive color recording paper 2. As a result, the thermosensitive color recording paper 2 detours round or makes a loop in the vertical transport path section.

A second guide roller 14 is placed behind the vertical path section, to gently turn the thermosensitive color recording paper 2 into a horizontal direction, and a paper aligning device 15 for aligning the thermosensitive color recording paper 2 is disposed in this gently curved paper transport path section. The path size switching plate 10 is set in the widening position while the thermosensitive color recording paper 2 is being subjected to the aligning by the paper aligning device 15, so the thermosensitive color recording paper 2 forms a loop between the first guide roller 9 and the second guide roller 14 during the paper alignment. The loop absorbs distortions of the thermosensitive color recording paper 2 that may have resulted from the paper aligning. The path size switching plate 10 is set in the widening position also while the thermosensitive color recording paper 2 is subjected to printing, so as to absorb any distortion of the thermosensitive color recording paper 2 that may be provided during the printing.

The path size switching plate 10 is set in the limiting position while the thermosensitive color recording paper 2 is being conveyed in the paper supply direction. In the limiting position, the path size switching plate 10 narrows the vertical path section in the direction of the thickness of the recording paper 2, so the thermosensitive color recording paper 2 is not loosened behind the first guide roll 9 as it is conveyed in the paper supply direction, and thus prevented from getting jammed.

Figure 2:
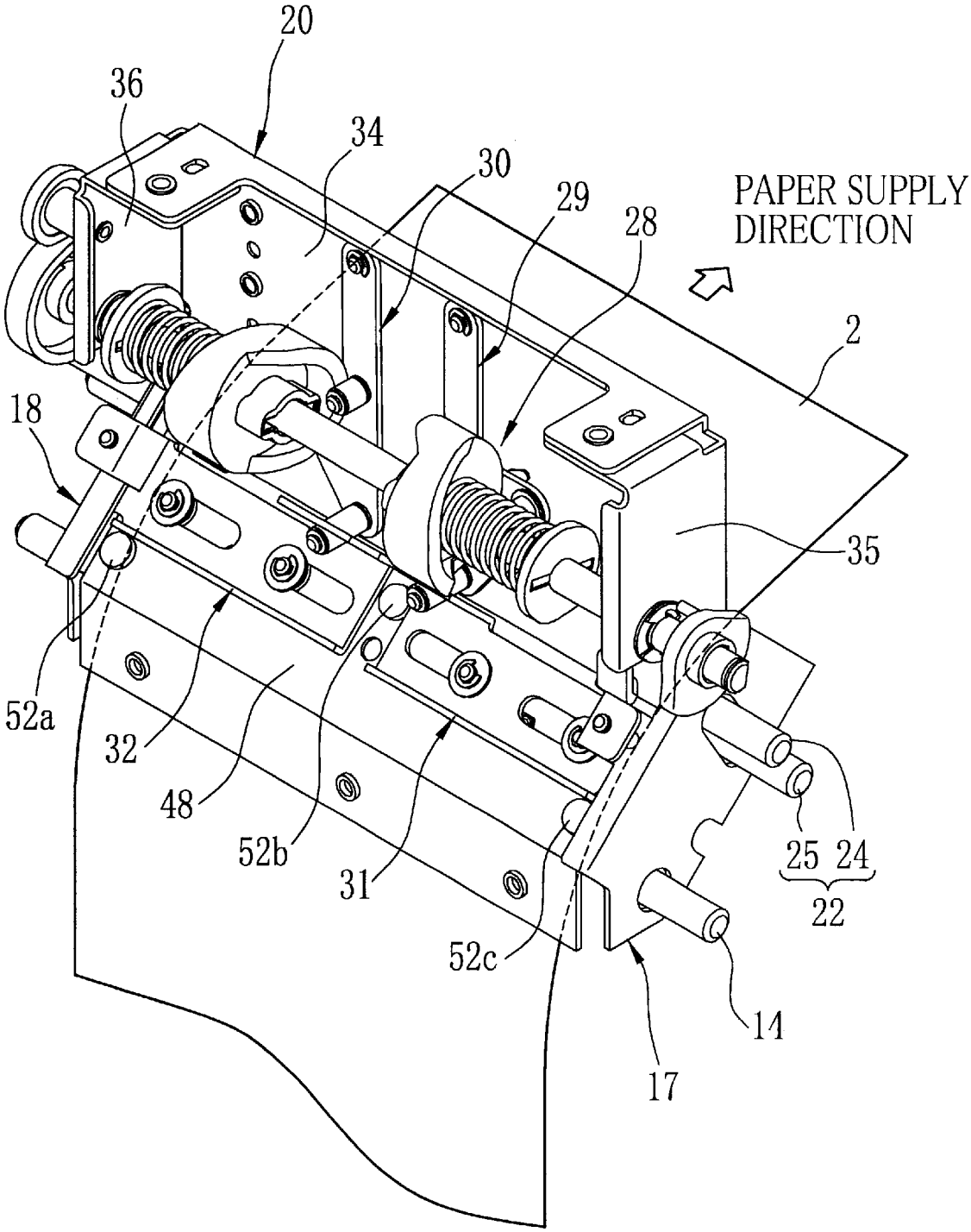
FIG. 2 is a perspective view of a paper aligning device of the thermosensitive color printer.
Figure 3:
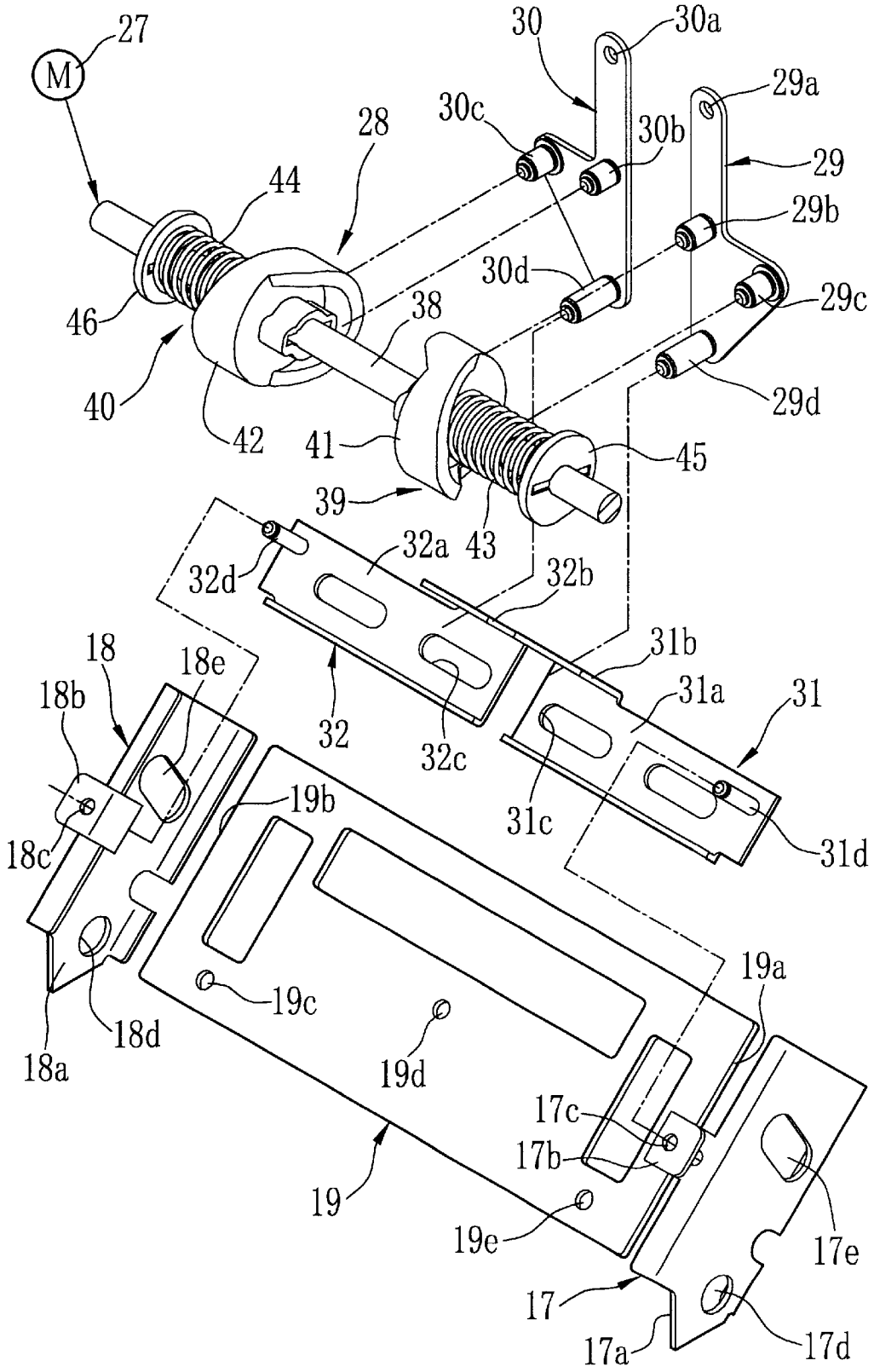
FIG. 3 is an exploded perspective view of a driving mechanism of the paper aligning device.

As shown in FIGS. 2 and 3, the aligning device 15 is constituted of a pair of guide members 17 and 18, a drive mechanism 21 and a stopping plate 19. The guide members 17 and 18 are disposed on opposite lateral sides of the paper transport path, and are driven by the driving mechanism to slide between an aligning position limiting the lateral position of the recording paper 2 on the paper transport path, on one hand, and a retracted position removed away from the transport path. The stopping plate 19 is disposed in between the guide members 17 and 18, to define the aligning position of the guide members 17 and 18. These elements are mounted on an aligning frame 20 that is formed by bending a metal blade.

In the present embodiment, the guide members 17 and 18 are each formed by bending a metal blade into a substantially channel shape. Middle surfaces 17*a* and 18*a* of the channel shapes of the guide members 17 and 18 are oriented perpendicular to the stopping plate 19, and come into contact with side edges of the thermosensitive color recording paper 2 in the aligning position, so these surfaces 17*a* and 18*a* will be called aligning surfaces 17*a* and 18*a*. Bearing arms 17*b* and 18*b* are formed above the channel shaped portions of the guide members 17 and 18, and are bent laterally outward of the paper transport path, whereas the channel shaped portions are bent toward the paper transport path. A bearing hole 17*c* or 18*c* is formed through either of the bearing arms 17*b* and 18*b*.

The aligning surfaces 17*a* and 18*a* are each formed with a round opening 17*d* or 18*d* and an elliptic opening 17*e* or 18*e*. The second guide roller 14 is put through the round openings 17*d* and 18*d*. Opposite ends of the second guide roller 14 are rotatably supported by a not-shown internal frame of the thermosensitive color printer. Through the elliptic openings 17*e* and 18*e*, opposite ends of a pair of position keeping rollers 22 are inserted to be supported rotatably by the internal frame of the thermosensitive color printer.

The position keeping roller pair 22 nips and feeds the thermosensitive color recording paper 2 through the curved paper transport path section. The position keeping roller pair 22 consists of a capstan roller 24 that is driven to rotate by the feed motor 7, and a nip roller 25 movable between a nipping position pressed on the capstan roller 24 and a retracted position away from the capstan roller 24. The nip roller 25 is shifted between the nipping position and the retracted position by a not-shown shift mechanism that may be constituted of a solenoid and cam members. The nip roller 25 is moved to the retracted position while the aligning device 15 is aligning the thermosensitive color recording paper 2, for allowing the thermosensitive color recording paper 2 to move freely. After the completion of aligning, the nip roller 25 is moved to the nipping position to nip the thermosensitive color recording paper 2 between the position keeping roller pair 22, thereby keeping the thermosensitive color recording paper 2 at the aligned position. Thus, the thermosensitive color recording paper 2 is prevented from being skewed or out of the center.

The drive mechanism 21 is constituted of a cam shaft 28 that is rotated by an aligning motor 27, a pair of swing levers 29 and 30 that convert rotational movement of the cam shaft 28 into swinging movement, and a pair of sliding levers 31 and 32 that convert the swinging movement of the swing levers 29 and 30 into sliding movement. The cam shaft 28 consists of a rotary shaft 38 and a pair of cam portions 39 and 40 that are mounted on the rotary shaft 38 and rotates together with the rotary shaft 38. The rotary shaft 38 is rotatably supported by vertical side walls 35 and 36 of the aligning frame 20. The cam portions 39 and 40 have the same structure and are arranged symmetrical in the axial direction. The cam portion 39 or 40 consists of a rotary cam 41 or 42 whose thickness and position in the axial direction varies with its circumferential position, a spring 43 or 44 for urging the rotary cam 41 or 42 toward each other, i.e. toward the center of the paper transport path, and a holding disc 45 or 46 for holding the spring 43 or 44, respectively. The rotary cams 41 and 42, and the holding discs 45 and 46 are positioned by not-shown pins that are inserted through the rotary shaft 38.

The swing levers 29 and 30 are each formed from a metal blade into a shape like an arrow. Pivot holes 29*a* and 30*a* are formed through upper ends of the swing levers 29 and 30. The pivot holes 29*a* and 30*a* are rotatably fit on pins that are formed on a center vertical wall 34 of the aligning frame 20, so the swing levers 29 and 30 may swing about the pins.

Figure 4:
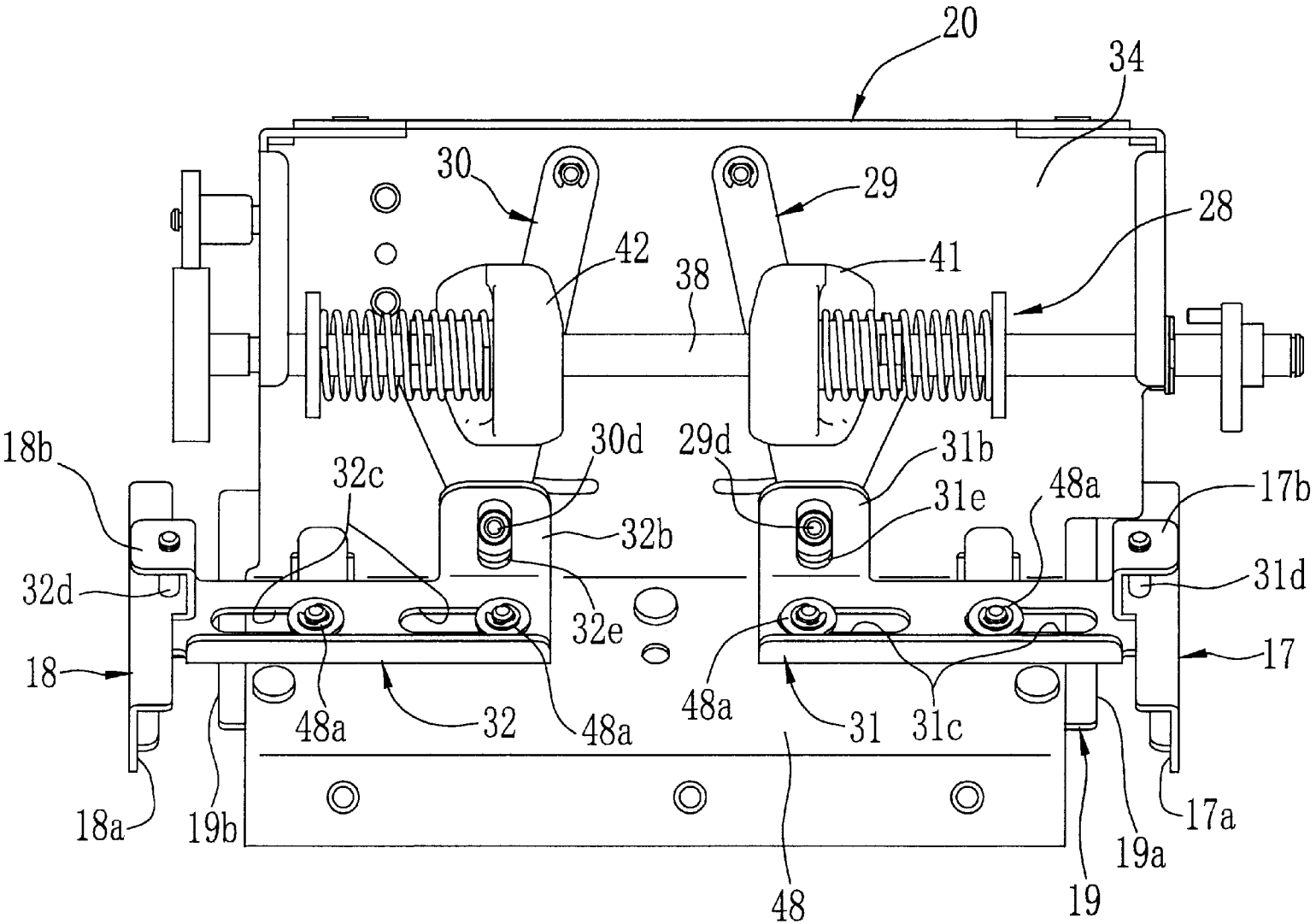
FIG. 4 is a front view of the paper aligning device in a released position.
Figure 5:
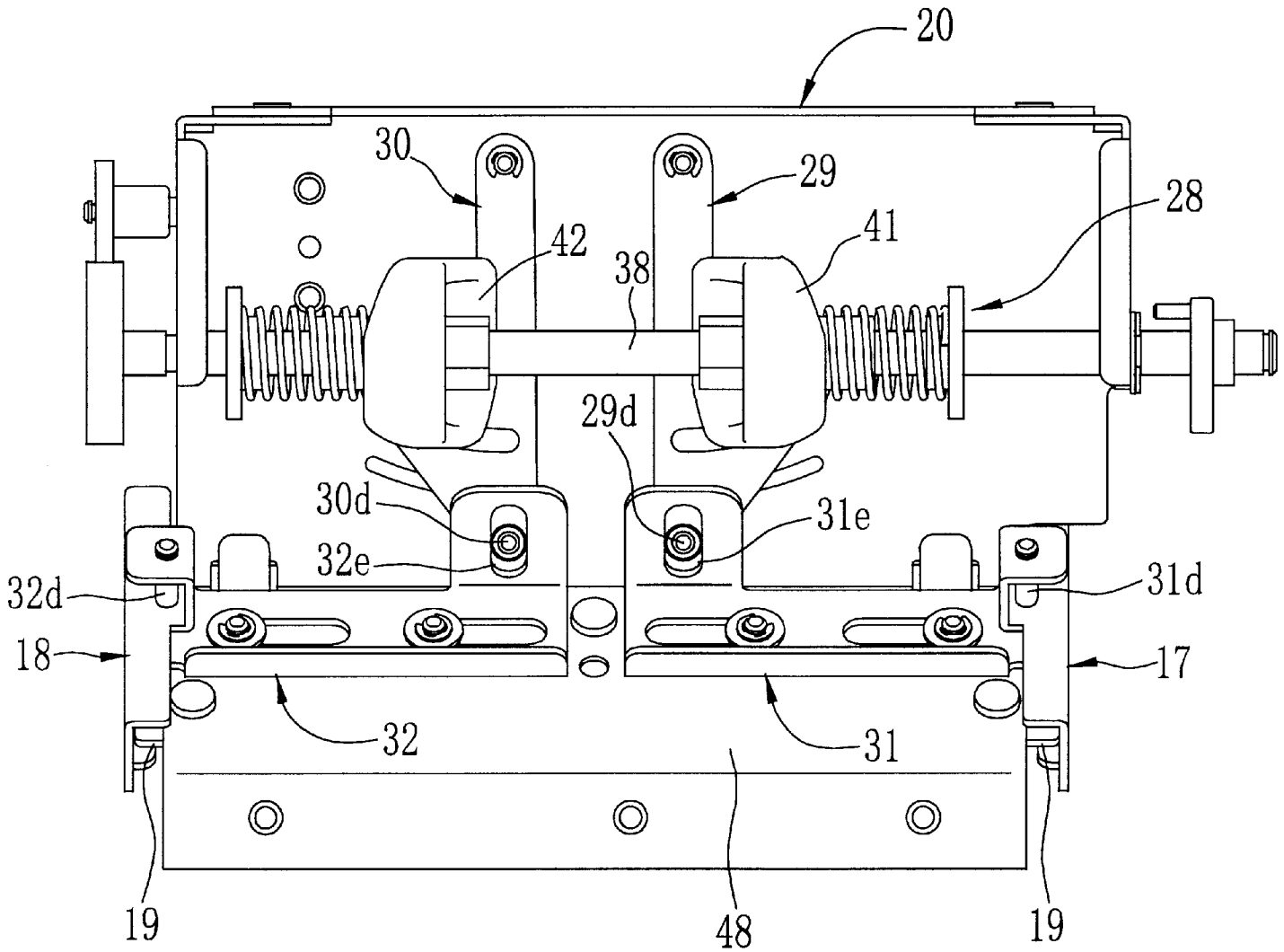
FIG. 5 is a front view of the paper aligning device in an aligning position.

At corners of a lower triangular portion of each swing lever 29 or 30 are formed three axles that protrude toward the cam shaft 28, and cylindrical rollers are mounted rotatably on these axles, providing link shafts 29*b*, 29*c* and 29*d*, 30*b*, 30*c* and 30*d*. The upper two link shafts 29*b* and 29*c* of the swing lever 29 are placed on opposite sides of the rotary cam 41 in the axial direction of the cam shaft 28, and nip the rotary cam 41. In the same way, the upper two link shafts 30*b* and 30*c* of the swing lever 30 are placed on opposite sides of the rotary cam 42 in the axial direction, and nip the rotary cam 42. According to this configuration, as the cam shaft 28 turns, the link shafts 29*b*, 29*c*, 30*b* and 30*c* are pushed in one axial direction and the other by the rotary cams 41 and 42 because of their varying thickness and axial position. As a result, the swing levers 29 and 30 move from an open position as shown in FIG. 4, to a closed position as shown in FIG. 5, and then return to the open position, while the cam shaft 28 makes one revolution.

The sliding lever 31 or 32 has a sliding plate 31*a* or 32*a* and a link wall 31*b* or 32*b* that is rectangular to the sliding plate 31*a* or 32*a* respectively. A pair of slots 31*c* or 32*c* are formed through the sliding plate 31*a* or 32*a*. The slots 31*c* and 32*c* extend in the axial direction of the rotary shaft 38, i.e. the lateral direction of the paper transport path. The slots 31*c* and 32*c* are hooked on guide pins 48*a* that are formed on a middle sloped surface 48 of the aligning frame 20, so that the sliding plates 31*a* and 32*a* may slide on the sloped surface 48 in the lateral direction of the paper transport path.

On outer ends of the sliding plates 31*a* and 32*a* with respect to the lateral direction of the paper transport path, there are provided pivot pins 31*d* and 32*d* respectively. The pivot pins 31*d* and 32*d* protrude perpendicularly to the sliding plates 31*a* and 32*a*, and are inserted into the bearing holes 17*c* and 18*c* of the bearing arms 17*b* and 18*b* of the guide members 17 and 18 respectively. Thus, the guide members 17 and 18 may pivot on the pivot pins 31*d* and 32*d*, so the aligning surfaces 17*a* and 18*a* may incline relative to the center line of the paper transport path.

Vertically elongated slots 31*e* and 32*e* are formed through the link walls 31*b* and 32*b* of the sliding levers 31 and 32. The link shafts 29*d* and 30*d* at the lower tips of the swing levers 29 and 30 are inserted into these slots 31*e* and 32*e* respectively. According to the linkage between the link shafts 29*d* and 30*d* and the link walls 31*b* and 32*b*, the sliding levers 31 and 32 slide in the lateral direction of the paper transport path, as the swing levers 29 and 30 swings. Thus, when the swing levers 29 and 30 move to the closed position as shown in FIG. 5, the guide members 17 and 18 mounted on the pivot pins 31*d* and 32*d* confine the thermosensitive color recording paper 2 in the lateral direction of the paper transport path, by pushing the side edges of the thermosensitive color recording paper 2 at the aligning surfaces 17*a* and 18*a*.

Since the thermosensitive color recording paper 2 is gently curved in the aligning device 15, stiffness or rigidity of the thermosensitive color recording paper 2 in its lateral direction or widthwise direction is enforced, so the thermosensitive color recording paper 2 is hardly bent or folded while its side edges are pushed by the aligning surfaces 17*a* and 18*a* of the guide members 17 and 18.

Figure 6:
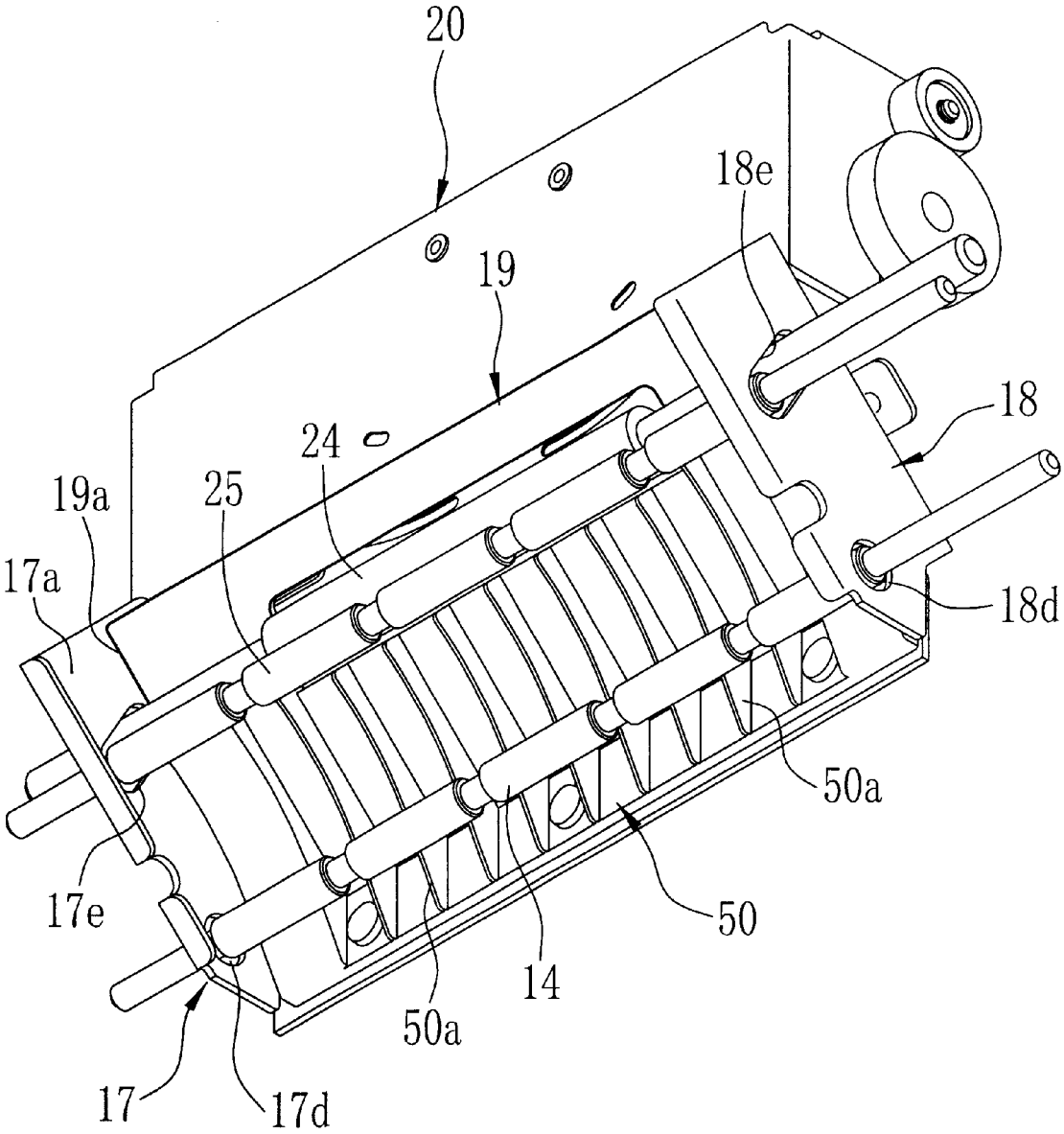
FIG. 6 is a bottom perspective view of the paper aligning device.

As shown in FIG. 6, the stopping plate 19 and a guide plate 50 are disposed under the sloped surface 48 of the aligning frame 20. The aligning surfaces 17*a* and 18*a* of the guide members 17 and 18 come to contact with opposite side edges 19*a* and 19*b* of the stopping plate 19, as the swing levers 29 and 30 move to the closed position. Thus, the stopping plate 19 limits the pressing position of the guide members 17 and 18 to the thermosensitive color recording paper 2. The side edges 19*a* and 19*b* of the stopping plate 19 extend in parallel to the paper transport path. The guide plate 50 is formed with a plurality of guide ribs 50*a* whose guiding edges are gently convave correspondingly to the curvature of the thermosensitive color recording paper 2 that turns around the second guide roller 14, so the thermosensitive color recording paper 2 is guided to the position keeping roller pair 22 while sliding on the guide ribs 50*a*.

As shown in FIG. 3, the stopping plate 19 is formed from a metal blade, and has openings for avoiding interference with the capstan roller 24 of the position keeping roller pair 22. The distance between the opposite side edges 19*a* and 19*b* of the stopping plate 19 is defined to be equal to a minimum width of the thermosensitive color recording paper 2 within a dimensional tolerance, so the thermosensitive color recording paper 2 is aligned without fail even while there are variations in the width of the thermosensitive color recording paper 2.

The stopping plate 19 has three screw holes 19*c*, 19*d* and 19*e*, and three screw bolts 52*a*, 52*b* and 52*c* are screwed into these screw holes 19*c* to 19*e* through three holes (not shown) that are formed through the sloped surface 48 of the aligning frame 20, thereby mounting the stopping plate 19 to the sloped surface 48. The holes through the sloped surface 48 have a larger diameter than that of the screw bolts 52*a* to 52*c*, so the position and angle of the stopping plate 19 may be fine-adjusted in the widthwise direction of the thermosensitive color recording paper 2 relative to the aligning frame 20.

A pair of feed rollers 54 are disposed behind the aligning device 15 in the paper supply direction. The feed roller pair 54 consists of a capstan roller 55 driven by the feed motor 7 and a nip roller 56. The nip roller 56 may be shifted between a nipping position pressed against the capstan roller 55 and a retracted position away from the capstan roller 55 by a not-shown shift mechanism that may be constituted of a solenoid and cam members. In the nipping position of the nip roller 56, the thermosensitive color recording paper 2 is nipped and conveyed by the feed roller pair 54.

The paper transport path is directed vertical again behind the feed roller pair 54 in the paper supply direction, and a thermal head 58 and a platen roller 59 are disposed on opposite sides of this vertical transport path section. The thermal head 58 has a heating element array 58*a* consisting of a large number of heating elements arranged in the lateral direction of the paper transport path. The platen roller 59 may be shifted between a pressing position where the platen roller 59 is in contact with the heating element array 58*a* and a retracted position away from the thermal head 58 by a not-shown shift mechanism that may be constituted of a solenoid and cam members.

The platen roller 59 is located at the retracted position while the thermosensitive color recording paper 2 is being conveyed in the paper supply direction by the feed roller pair 54. While the thermosensitive color recording paper 2 is being conveyed in the printing or rewinding direction by the feed roller pair 54, the platen roller 59 is shifted to the pressing position to press the thermosensitive color recording paper 2 onto the heating element array 58*a*, and the thermal head 58 is driven to heat the heating element array 58*a* up to designated temperatures to cause the coloring layers of the thermosensitive color recording paper 2 to develop respective colors in a color sequential fashion. The platen roller 59 rotates following the movement of the conveyed recording paper 2, in the pressing position.

The paper transport path is curved behind the thermal head 58 in the paper supply direction, and a yellow fixing device 61 and a magenta fixing device 62 are disposed inside of the curve. The fixing devices 61 and 62 respectively consist of ultraviolet lamps 63 and 64 and a reflector 65 and 66. The ultraviolet lamps 63 of the yellow fixing device 61 radiate near-ultraviolet rays having an emission peak of 420 nm, for fixing the yellow coloring layer of the thermosensitive color recording paper 2 after a yellow frame of a full-color image is thermally recorded thereon. On the other hand, the ultraviolet lamps 64 of the magenta fixing device 62 radiate ultraviolet rays having an emission peak of 365 nm, for fixing the magenta coloring layer after a magenta frame of the full-color image is recorded thereon.

A paper ejection path 68 and a subsidiary transport path 69 are provided behind the yellow fixing device 61 in the paper supply direction. A course switching plate 70 is provided for directing the thermosensitive color recording paper 2 either to the paper ejection path 68 or to subsidiary paper transport path 69. While the thermosensitive color recording paper 2 is subjected to the thermal recording and optical fixing, the thermosensitive color recording paper 2 is guided to the subsidiary transport path 69. After the thermal recording and optical fixing of the full-color image is completed, the thermosensitive color recording paper 2 is guided to the paper ejection path 68.

A paper cutter 72 and a pair of ejection rollers 73 are disposed in the paper ejection path 68. The paper cutter 72 cuts off a leading portion of the thermosensitive color recording paper 2 having the full-color image printed thereon, providing a printed sheet 76. The ejection roller pair 73 is driven by the feed motor 7, to eject the printed sheet 76 onto an ejection tray 74. Although they are omitted from the drawings, guide members are provided appropriately along the paper transport path.

Now the operation of the present embodiment will be described with reference to the flowchart of FIG. 10.

The thermosensitive color printer is supplied with image data from a personal computer, a video player, or a data recording medium, such as a card memory. The image data fed in the thermosensitive color printer is monitored as video images on a display device that is not shown but connected to the thermosensitive color printer. An image to print is selected from among the displayed images by operating a not-shown console of the thermosensitive color printer.

When a printer start button of the console is operated, a not-shown system controller of the thermosensitive color printer starts a printing process. In the printing process, the feed motor 7 is first driven to rotate the paper supply roller 6 in the paper supply direction, thereby the paper roll 3 is rotated in a counterclockwise direction in FIG. 1, feeding a leading end of the thermosensitive color recording paper 2 out of the paper magazine 4 into the paper transport path.

The thermosensitive color recording paper 2, after being fed out from the paper magazine 4, is turned by the first guide roller 9 into the vertical transport path section. While the thermosensitive color recording paper 2 is being conveyed in the paper supply direction, the path size switching plate 10 is in the limiting position as shown by solid lines in FIG. 1, so the thermosensitive color recording paper 2 is guided along the vertical transport path section without forming an unnecessary loop. Accordingly, the thermosensitive color recording paper 2 is prevented from getting jammed in the vertical transport path section.

Figure 7:
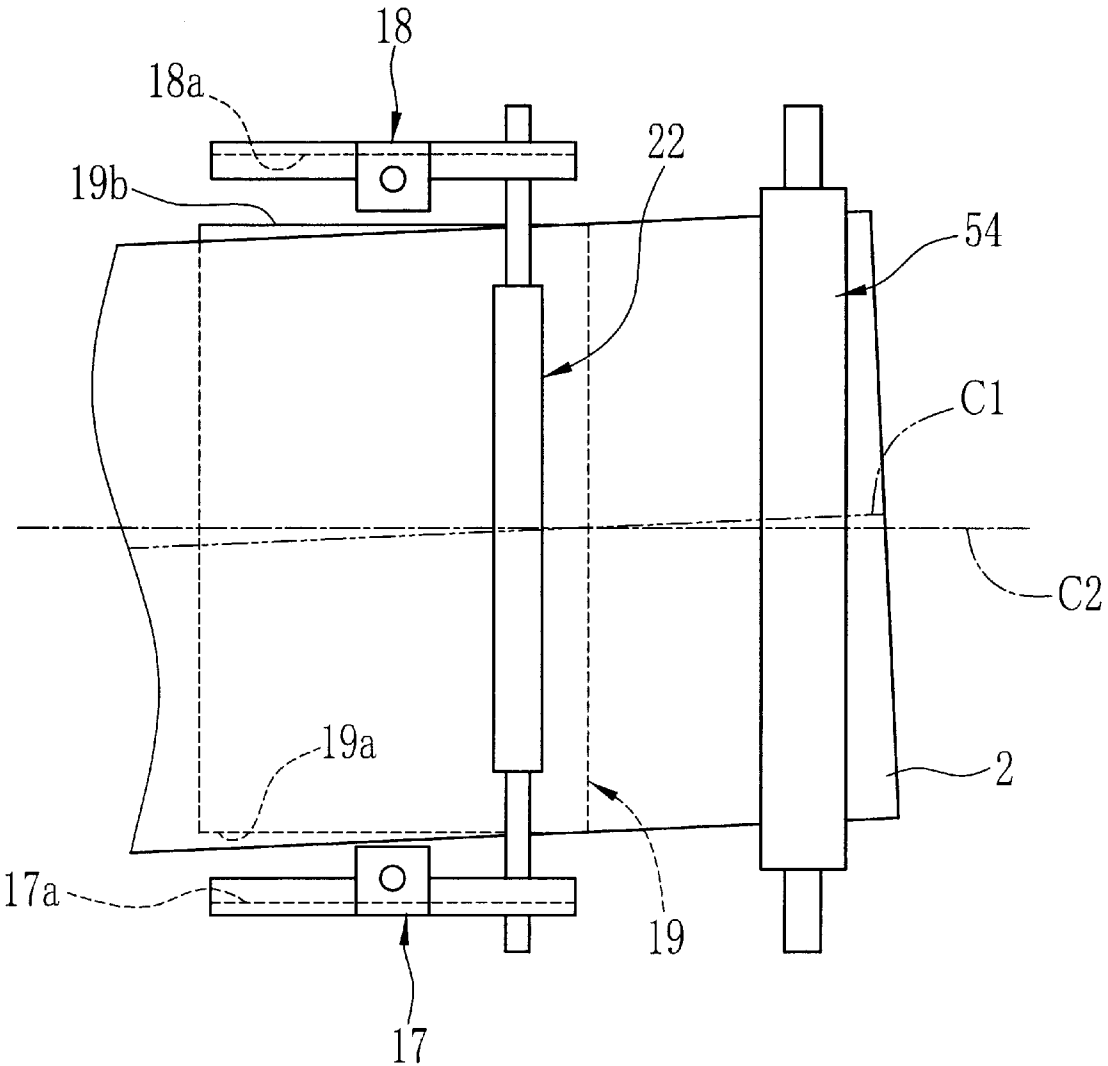
FIG. 7 is a top plan view of the paper aligning device before starting aligning.

After passing through the vertical transport path in the paper supply direction, the thermosensitive color recording paper 2 is fed into the aligning device 15 while being curved gently by the second guide roller 14 and the guide plate 50. At the start of the printing process, the aligning device 15 is set in an initial position as shown in FIG. 4, where the swing levers 29 and 30 are their open position, because the rotary cams 41 and 42 of the cam shaft 28 push the outer link shafts 29*c* and 30*c* laterally outward of the paper transport path. Because the sliding levers 31 and 32 are linked to the swing lever 29 and 30 through the link shafts 29*d* and 30*d*, the spacing between the sliding levers 31 and 32 and thus the spacing between the guide members 17 and 18 are maximized to widen the paper transport path in the widthwise direction of the thermosensitive color recording paper 2, so the thermosensitive color recording paper 2 is smoothly feed into the aligning device 15, as shown in FIG. 7.

The nip roller 25 of the position keeping roller pair 22 is located at the retracted position while the thermosensitive color recording paper 2 is being conveyed in the paper supply direction. So the thermosensitive color recording paper 2 moves past the position keeping roller pair 22 and comes in between the capstan roller 55 and the nip roller 56 of the feed roller pair 54.

When the leading end of the thermosensitive color recording paper 2 comes in between the feed roller pair 54, the feed motor 7 is deactivated to stop conveying the thermosensitive color recording paper 2. Simultaneously with the stop of conveying the thermosensitive color recording paper 2, the shift mechanism 12 is driven to switch the path size switching plate 10 from the limiting position to the widening position as shown by phantom lines in FIG. 1. Thereafter, the aligning motor 27 of the aligning device 15 is driven to rotate the cam shaft 28. As a result, the rotary cams 41 and 42 of the cam shaft 28 push the inner link shafts 29*b* and 30*b* of the swing levers 29 and 30 laterally inward of the paper transport path, causing the swing levers 29 and 30 to swing from the initial open position to the closed position, as shown in FIG. 5.

Figure 8:
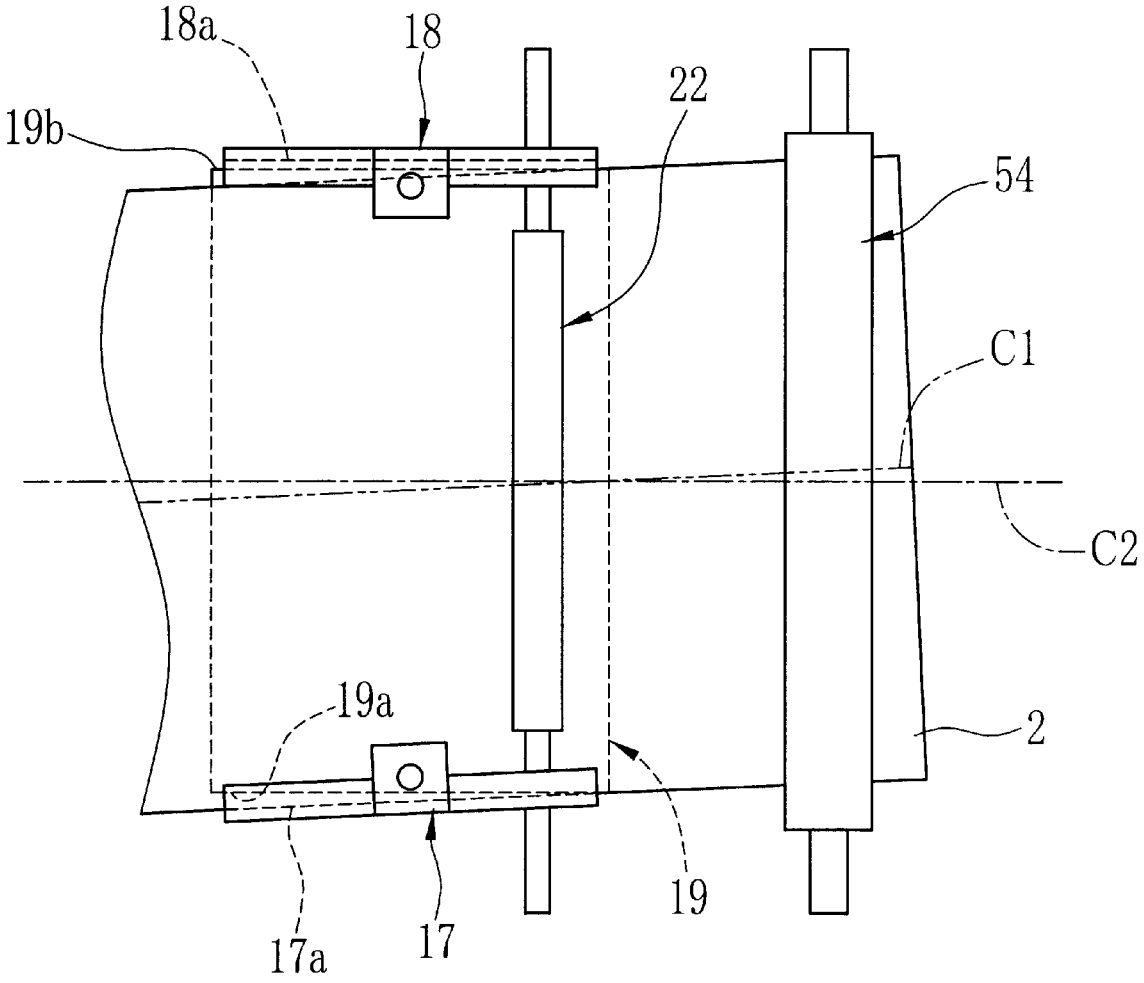
FIG. 8 is a top plan view of the paper aligning device during the aligning.

With the swing of the swing levers 29 and 30 to the closed position, the sliding levers 31 and 32 slide toward each other, so the aligning surfaces 17*a* and 18*a* of the guide members 17 and 18 push the side edges of the thermosensitive color recording paper 2, as shown in FIG. 8. As described above, the thermosensitive color recording paper 2 can be skewed, i.e., a center line C1 of the thermosensitive color recording paper 2 is inclined to the center line C2 of the paper transport path, as shown for instance in FIGS. 7 and 8.

Since the guide members 17 and 18 may pivot on the pivot pins 31*d* and 32*d* of the sliding levers 31 and 32, the aligning surfaces 17*a* and 18*a* are soon brought into tight contact with one side edge of the thermosensitive color recording paper 2, so the pressure is applied uniformly to the side edges. Accordingly, the risk of damaging the side edge of the thermosensitive color recording paper 2 by pushing it at a point is eliminated. Since the thermosensitive color recording paper 2 is gently curved in a portion located between the guide members 17 and 18, stiffness of the thermosensitive color recording paper 2 in the widthwise direction is increased in comparison with where the thermosensitive color recording paper 2 is flat and plane. Accordingly, it is possible to align the thermosensitive color recording paper 2 to be parallel to the paper transport path, while preventing the side edges from being bent or folded by the guide members 17 and 18.

Figure 9:
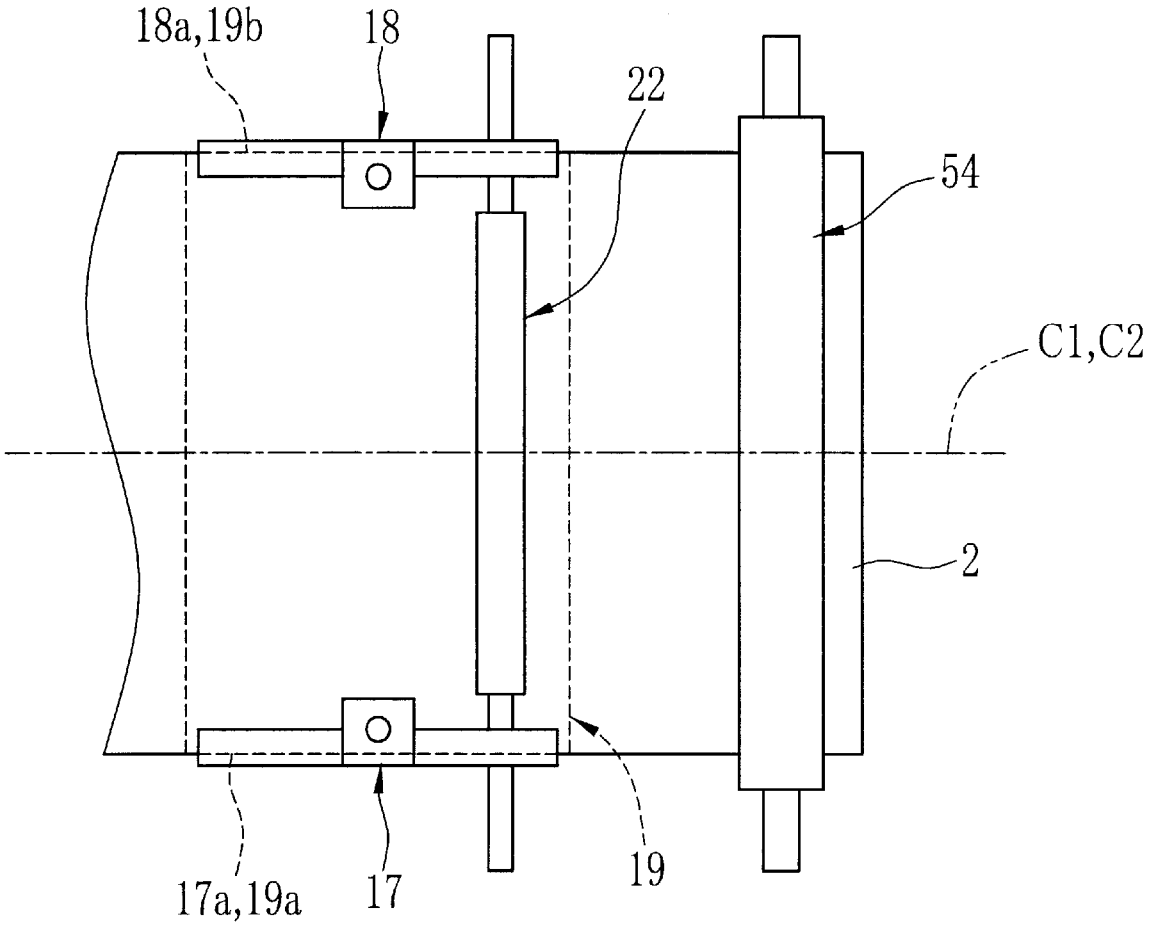
FIG. 9 is a top plan view of the paper aligning device at the end of aligning.

In this way, the guide members 17 and 18 push the side edges of the thermosensitive color recording paper 2 on the way to move toward each other. As the guide members 17 and 18 move further toward each other, the aligning surfaces 17*a* and 18*a* come to contact with the side edges 19*a* and 19*b* of the stopping plate 19, as shown in FIG. 9, so the guide members 17 and 18 as well as the sliding levers 31 and 32 stop at this position. Since the side edges 19*a* and 19*b* of the stopping plate 19 extend in parallel to the center line C2 of the paper transport path, the aligning surfaces 17*a* and 18*a* of the guide members 17 and 18 are made parallel to the center line C2, so the thermosensitive color recording paper 2 is directed parallel to the paper transport path. Since the length of the stopping plate 19 in the widthwise direction is defined to be equal to the minimum tolerable width of the thermosensitive color recording paper 2, the center line C1 of the thermosensitive color recording paper 2 is aligned with the center line C2 of the paper transport path, as shown in FIG. 9, even though the width of the thermosensitive color recording paper 2 varies within the tolerable range.

During the aligning by the aligning device 15, the path size switching plate 10 is kept in the widening position. Accordingly, even though torsion is applied to the thermosensitive color recording paper 2 by correcting the skewed position to the parallel position to the paper transport path, the torsion is absorbed by the loop of the thermosensitive color recording paper 2 formed in the vertical transport path section between the first guide roller 9 and the second guide roller 14, as shown by solid lines in FIG. 1. Therefore, the thermosensitive color recording paper 2 is prevented from being bent or wrinkled that would otherwise be resulted from the torsion of the thermosensitive color recording paper 2.

The aligning motor 27 stops after rotating by an amount corresponding to a half revolution of the cam shaft 28, so the aligning device 15 stops at the aligning position as shown in FIG. 9 where the thermosensitive color recording paper 2 is aligned with the paper transport path by being confined by the guide members 17 and 18. Then, the nip roller 56 of the feed roller pair 54 is moved to the nipping position to nip the thermosensitive color recording paper 2 between the feed roller pair 54. Immediately thereafter, the nip roller 25 of the position keeping roller pair 22 is moved to the nipping position to nip the thermosensitive color recording paper 2 between the position keeping roller pair 22.

After the thermosensitive color recording paper 2 is nipped between the position keeping roller pair 22, the aligning motor 27 starts rotating the cam shaft 28 by another half revolution, thereby causing the rotary cams 41 and 42 to push the outer link shafts 29*c* and 30*c*. So the swing levers 29 and 30 and thus the sliding levers 31 and 32 are brought to the initial open position as shown in FIG. 4, removing the guide members 17 and 18 from the side edges of the thermosensitive color recording paper 2. Since the thermosensitive color recording paper 2 is nipped by the position keeping roller pair 22 and the feed roller pair 54, the thermosensitive color recording paper 2 is held in the aligned condition even after being released from the confinement of the guide members 17 and 18. It is possible to cause the position keeping roller pair 22 to nip the thermosensitive color recording paper 2 simultaneously with the feed roller pair 54.

When the aligning device 15 returns to the initial position, the shift mechanism 12 is driven to move the path size switching plate 10 from the widening position to the limiting position. Then, the feed motor 7 is driven to rotate the position keeping roller pair 22 and the feed roller pair 54 in the paper supply direction. The feed roller pair 54 is designed to feed the thermosensitive color recording paper 2 at a higher speed than the position keeping roller pair 22, so tension is applied to the thermosensitive color recording paper 2 between the position keeping roller pair 22 and the feed roller pair 54. Because of the tension, the thermosensitive color recording paper 2 turns around the capstan roller 55 of the feed roller pair 54 through a larger angle, so the rotational movement of the feed roller pair 54 is efficiently transmitted to the thermosensitive color recording paper 2. As a result, the thermosensitive color recording paper 2 is stably conveyed along the paper transport path and prevented from being skewed.

The thermosensitive color recording paper 2 is further conveyed by the feed roller pair 54 in the paper supply direction, so the leading end of the thermosensitive color recording paper 2 moves past the thermal head 58 and the platen roller 59, and then past the fixing devices 61 and 62. While the thermosensitive color recording paper 2 is being supplied from the paper magazine 4, the course switching plate 70 is in a position as shown by phantom lines in FIG. 1, so the leading end of the thermosensitive color recording paper 2 is fed into the subsidiary transport path.

When the length of the thermosensitive color recording paper 2 behind the heating element array 58*a* of the thermal head 58 in the paper supply direction comes to be corresponding to one image recording area, the feed motor 7 stops, and the platen roller 59 is moved to the pressing position to press the thermosensitive color recording paper 2 onto the heating element array 58*a*. At the same time, the path size switching plate 10 is switched from the limiting position to the widening position.

Next, the feed motor 7 is driven to rotate the feed roller pair 54, the position keeping roller pair 22 and the paper supply roller 6 in the rewinding or printing direction. While the thermosensitive color recording paper 2 is being conveyed in the rewinding direction, the conveying speed of the position keeping roller pair 22 is set higher than those of the feed roller pair 54 and the paper supply roller 6. As a result, the thermosensitive color recording paper 2 is tensed between the feed roller pair 54 and the position keeping roller pair 22. Because of the tension between the feed roller pair 54 and the position keeping roller pair 22, the thermosensitive color recording paper 2 is prevented from being skewed or deviated relative to the center line C2 of the paper transport path.

On the other hand, because the position keeping roller pair 22 rotates at the higher speed than the position keeping roller pair 22 in the rewinding direction, the thermosensitive color recording paper 2 is loosened between the position keeping roller pair 22 and the paper supply roller 6, i.e., in the vertical transport path section that is widened in the direction of thickness of the thermosensitive color recording paper 2 at that time. Therefore, torsion of the thermosensitive color recording paper 2 that can be generated during the paper transport in the rewinding direction is absorbed in the vertical transport path section, so the thermosensitive color recording paper 2 is prevented from being bent or wrinkled.

When a leading edge of the image recording area of the thermosensitive color recording paper 2 in the printing or rewinding direction reaches the thermal head 58, the heating element array 58*a* heats the thermosensitive color recording paper 2 to start recording a yellow frame of a full-color image on the yellow coloring layer. The yellow frame is recorded one line after another in synchronism with the movement of the thermosensitive color recording paper 2 in the printing direction. When the yellow frame is recorded on the entire image recording area, the feed motor 7 stops and thus the thermosensitive color recording paper 2 stops. Then, the platen roller 59 is moved to the retracted position away from the thermal head 58, and the feed motor 7 is driven to rotate the feed roller pair 54 in the paper supply direction again.

Simultaneously with the start of conveying the thermosensitive color recording paper 2 in the paper supply direction, the path size switching plate 10 is moved to the limiting position, and the ultraviolet lamp 63 of the yellow fixing device 61 is turned on to optically fix the yellow coloring layer of the image recording area having the yellow frame recorded thereon. When the yellow fixing of the image recording area is finished, the feed motor 7 stops, and the platen roller 59 is moved to the pressing position again to nip the thermosensitive color recording paper 2 between the thermal head 58 and the platen roller 59. Simultaneously, the path size switching plate 10 is moved to the widening position. Then, the feed motor 7 is driven to rotate the feed roller pair 54, the position keeping roller pair 22 and the paper supply roller 6 in the printing direction. When the leading edge of the image recording area comes to the heating element array 58*a* as the recording paper 2 moves in the printing direction, the heating element array 58*a* starts recording a magenta frame of the full-color image line after line on the magenta coloring layer inside the image recording area.

When the magenta frame is recorded on the entire image recording area, the feed motor 7 stops and thus the thermosensitive color recording paper 2 stops. Then, the platen roller 59 is moved to the retracted position away from the thermal head 58, and the feed motor 7 is driven to rotate the feed roller pair 54 in the paper supply direction again. Simultaneously with the start of conveying the thermosensitive color recording paper 2 in the paper supply direction, the path size switching plate 10 is moved to the limiting position, and the ultraviolet lamp 64 of the magenta fixing device 62 is turned on to optically fix the magenta coloring layer of the image recording area. When the magenta fixing of the image recording area is finished, the feed motor 7 stops, and the platen roller 59 is moved to the pressing position again to nip the thermosensitive color recording paper 2 between the thermal head 58 and the platen roller 59. Simultaneously, the path size switching plate 10 is moved to the widening position. Then, the feed motor 7 is driven to rotate the feed roller pair 54, the position keeping roller pair 22 and the paper supply roller 6 in the printing or rewinding direction. When the leading edge of the image recording area of the thermosensitive color recording paper 2 comes to the heating element array 58*a*, the heating element array 58*a* starts recording a cyan frame of the full-color image, line after line on the cyan coloring layer inside the image recording area.

When the cyan frame is recorded on the entire image recording area, the feed motor 7 stops. Then, the platen roller 59 is moved to the retracted position, and the path size switching plate 10 is moved to the limiting position. Also the course switching plate 70 is switched to the ejecting position. Then the feed motor 7 is driven to rotate the feed roller pair 54 in the paper supply direction again. Because the cyan coloring layer has such coloring characteristics that it would not develop color under normal preservative conditions, the thermosensitive color printer does not make an optical fixing for the cyan coloring layer.

Since the course switching plate 70 is switched to the ejecting position, the thermosensitive color recording paper 2 as conveyed in the paper supply direction is fed into the paper ejection path 68, and then fed out through the ejection roller pair 73 onto the ejection tray 74. When the trailing edge of the image recording area in the paper supply direction, that is the leading edge thereof in the rewinding direction, is placed at the cutter 72, the feed motor 7 stops for a time, and the cutter 72 cuts the thermosensitive color recording paper 2, providing a sheet having the full-color printed thereon. Thereafter, the feed motor 7 is driven to rotate the ejection roller pair 73 to eject the printed sheet 76 onto the ejection tray 74.

Because the center line C1 of the thermosensitive color recording paper 2 is aligned with the center line C2 of the paper transport path before the start of printing the full-color image, and the feed roller pair 54 and the position keeping roller pair 22 maintain the thermosensitive color recording paper 2 in the aligned condition during the printing, the printed full-color image is free from inclination to or deviation from the center line C1. So the quality of the printed image is improved.

If there is not a next image to be printed in continuous succession, the feed motor 7 is driven to rotate the rollers 73, 54, 22, 9 and 6 in the rewinding direction to rewind the thermosensitive color recording paper 2 into the paper magazine 4, for the sake of protecting the thermosensitive color recording paper 2 from moisture.

Figure 10:
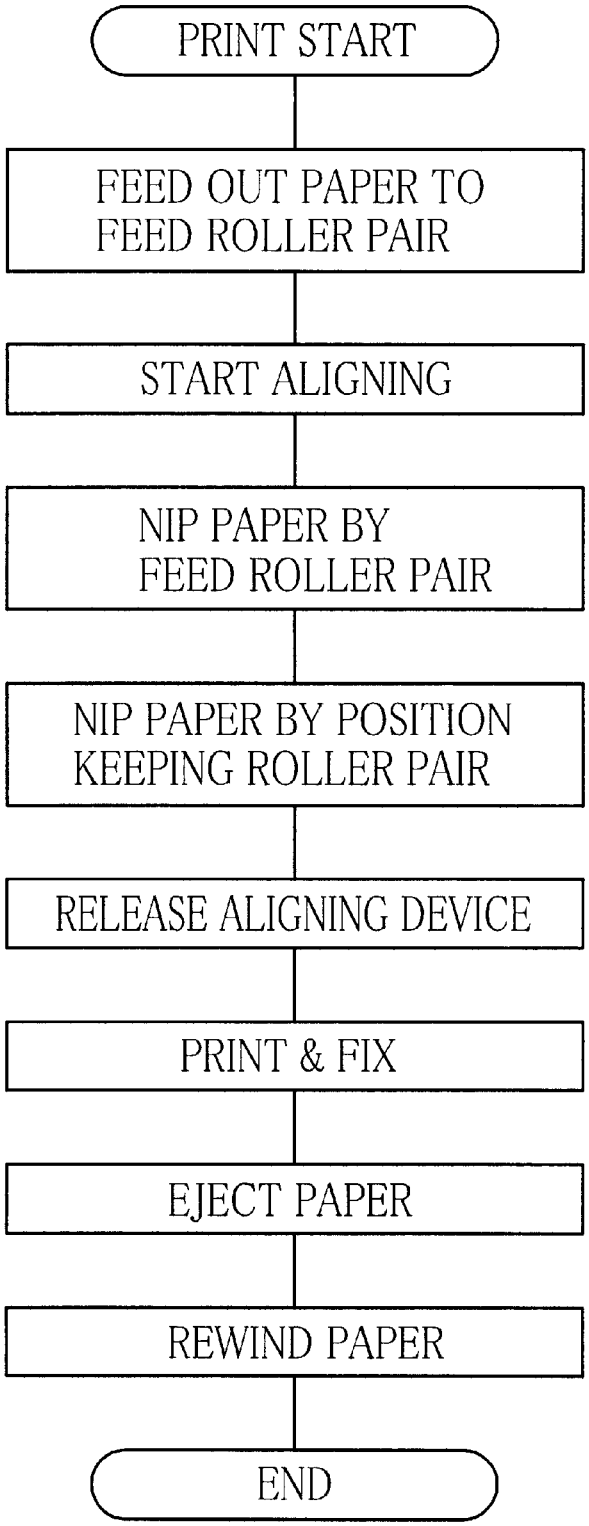
FIG. 10 is a flowchart illustrating the overall operation of the thermosensitive color printer.

The thermosensitive color printer of the above embodiment may also operate according to another sequence if the distance from the aligning device 15 to the feed roller pair 54 is so long that it is difficult to align the recording paper in the above described sequence that is shown in FIG. 10. In that case, it is preferable to activate the aligning device 15 before the leading end of the thermosensitive color recording paper 2 reaches the feed roller pair 54, and nip the thermosensitive recording paper 2 only by the position keeping roller pair 22 after the thermosensitive color recording paper 2 is aligned. After the aligning device 15 is reset to the initial position the thermosensitive color recording paper 2 is conveyed in between the feed roller pair 54, and nipped by the feed roller pair 54. Then, the thermal head 58 and the fixing devices 61 and 62 are driven in synchronism with the movement of the thermosensitive color recording paper 2 in the same way as described above.

Although the guide members 17 and 18 push the opposite side edges of the thermosensitive color recording paper 2 with the same pressure in the above embodiment, it is possible to design one of the guide members to apply a larger pressure than the other, such that the thermosensitive color recording paper 2 is aligned by being pressed by one guide member onto the other guide member. For this purpose, it is possible to change the sliding amount of one guide member from the other responsive to the revolution of the cam shaft by changing the shape of one sliding lever, swing lever or rotary cam from the other. It is also possible to differentiate the urging forces of the springs 43 and 44 on the cam shaft from each other, for differentiating the pressing force of the guide members from each other.

Although the stopping plate 19 for stopping the guide members at the aligning position in the lateral direction of the paper transport path is a single member in the above embodiment, it is possible to provide a pair of stopping plates for stopping the guide members respectively. In that case, it is preferable to configure the stopping plates to be individually adjustable in position and angle. It is also possible to use at least two pairs of stopping pins or the like for constituting a stopping device for stopping the guide members at the aligning position. It may also be possible to use a cam mechanism for shifting and stopping the guide members.

Indeed the present invention has been described so far with respect to the thermosensitive color printer that is loaded with a roll of thermosensitive color recording paper, but the present invention is applicable to those using cut sheet type recording paper.

Figure 11:
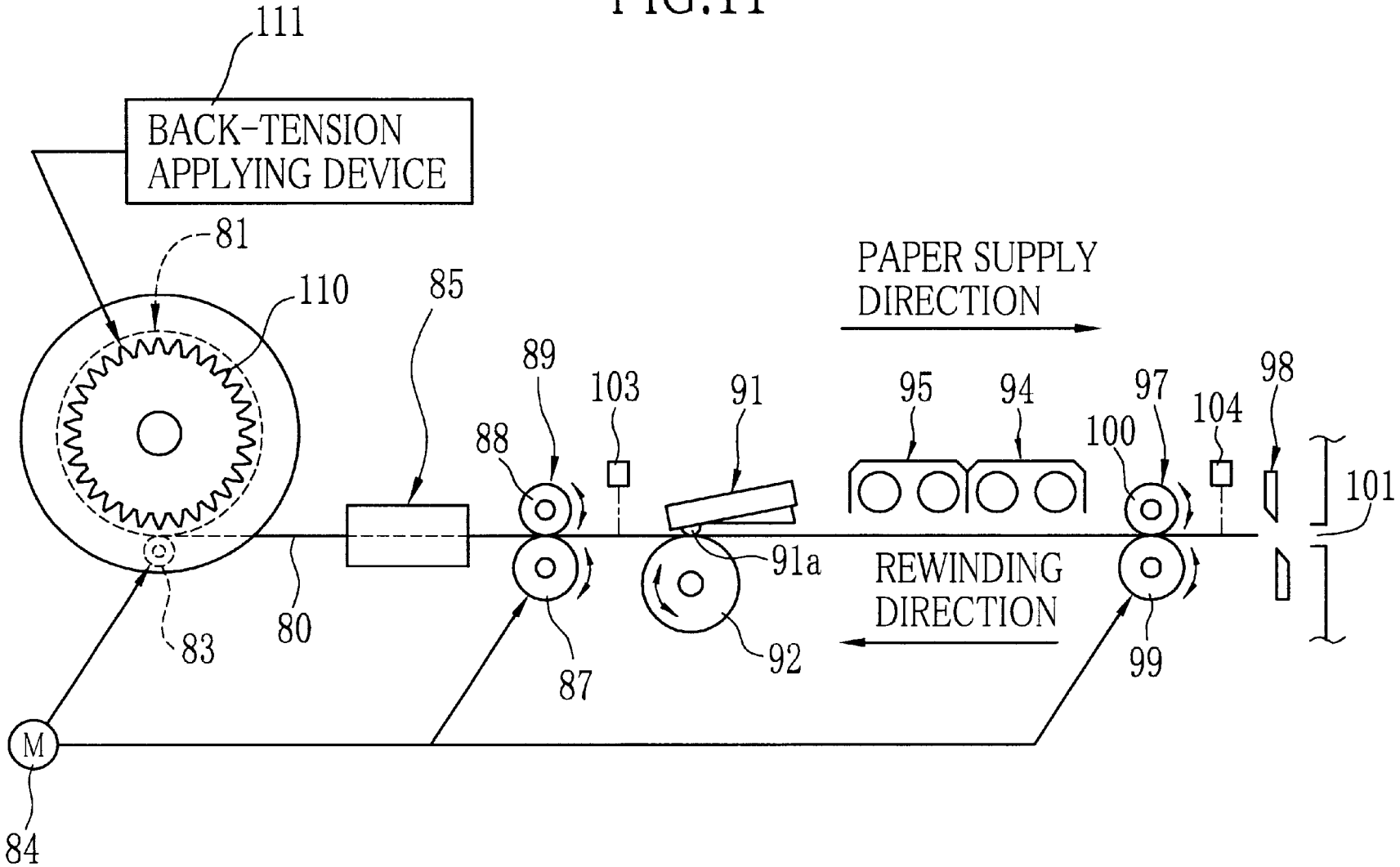
FIG. 11 is a schematic diagram illustrating a thermosensitive color printer according to a second embodiment of the present invention.

Although the paper transport path of the above embodiment is curved in several sections, the present invention is applicable to those printers whose paper transport path is straight-linear. FIG. 11 shows an embodiment of the present invention applied to a thermosensitive color printer having a straight-linear paper transport path and being loaded with a continuous web of thermosensitive color recording paper 80 wound into a roll 81.

The recording paper roll 81 is loaded in a not-shown roll chamber of the thermosensitive color printer. A paper supply roller 83 is provided in the roll chamber, such that the paper supply roller 83 is movable by a not-shown shift mechanism between a paper supply position pressed onto an outermost convolution of the recording paper roll 81, and a retracted position away from the recording paper roll 81. In the paper supply position, the paper supply roller 83 prevents the recording paper roll 81 from unwinding. A feed motor 84 rotates the paper supply roller 83 in a clockwise direction to feed out the thermosensitive color recording paper 80 from the recording paper roll 81.

An aligning device 85 is disposed behind the recording paper roll 81 in the paper supply direction. The aligning device 85 has a pair of guide members that are moved by a drive mechanism to push opposite side edges of the thermosensitive color recording paper 80. Except that the aligning device 85 is adapted to the straight-linear paper transport path and is not provided with a position keeping roller pair, the aligning device 85 is configured in the same way as the aligning device 15 of the first embodiment. Therefore, detailed description of the aligning device 85 is omitted.

A pair of feed rollers 89 are disposed behind the aligning device 15 in the paper supply direction. The feed roller pair 89 consists of a capstan roller 87 driven by the feed motor 84 and a nip roller 88. The nip roller 88 may be shifted between a nipping position pressed against the capstan roller 87 and a retracted position away from the capstan roller 87 by a not-shown shift mechanism. In the nipping position of the nip roller 88, the thermosensitive color recording paper 80 is nipped and conveyed by the feed roller pair 89 in a paper supply direction or in a rewinding direction.

A thermal bead 91 and a platen roller 92 are disposed on opposite sides of the paper transport path behind the feed roller pair 89 in the paper supply direction. The thermal bead 91 has a heating element array 91*a* consisting of a large number of heating elements arranged in the lateral direction of the paper transport path. The platen roller 92 may be shifted between a pressing position where the platen roller 92 is in contact with the heating element array 91*a* and a retracted position away from the thermal head 91 by a not-shown shift mechanism. In the pressing position, the platen roller 92 presses the thermosensitive color recording paper 80 onto the heating element array 91*a*.

Behind the thermal head 91 in the paper supply direction are disposed a yellow fixing device 94 for fixing a yellow coloring layer of the thermosensitive color recording paper 80 and a magenta fixing device 95 for fixing a magenta coloring layer of the thermosensitive color recording paper 80. An ejection roller pair 97 and a cutter 98 are disposed behind the yellow fixing device 94. The ejection roller pair 97 consists of a capstan roller 99 driven by the feed motor 84 and a nip roller 100 movable between a pressing position pressed onto the capstan roller 99 and a retracted position away from the capstan roller 99. Conveying speed of the ejection roller pair 97 is set a little lower than the feed roller pair 89. The ejection roller pair 97 conveys the thermosensitive color recording paper 80 by a designated length after a full-color image is printed thereon, and the cutter 98 cuts the thermosensitive color recording paper 80 into a sheet with the full-color image, so the sheet is ejected through an exit 101.

A first sensor 103 is disposed between the feed roller pair 89 and the thermal head, and a second sensor 104 is disposed between the ejection roller pair 97 and the cutter 98, both for detecting a leading edge of the thermosensitive color recording paper 80. The first and second sensors 103 and 104 are, for example, reflective photo sensors, and output a detection signal to a not-shown system controller when they detect the leading edge of the thermosensitive color recording paper 80. The system controller controls the overall operation of the thermosensitive color printer.

Figure 12:
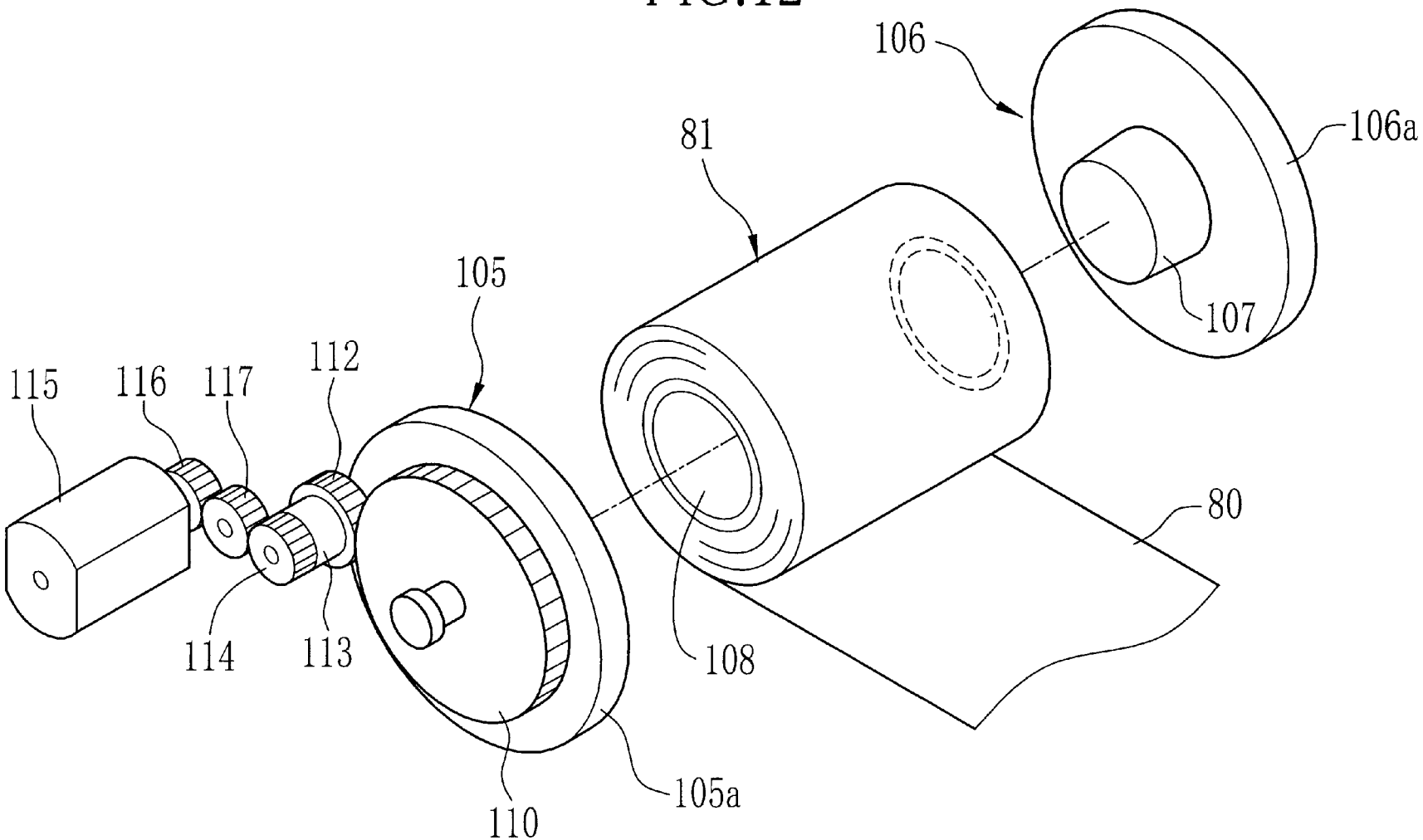
FIG. 12 is an explanatory perspective view of a back-tension applying device of the thermosensitive color printer of the second embodiment.
Figure 13A:
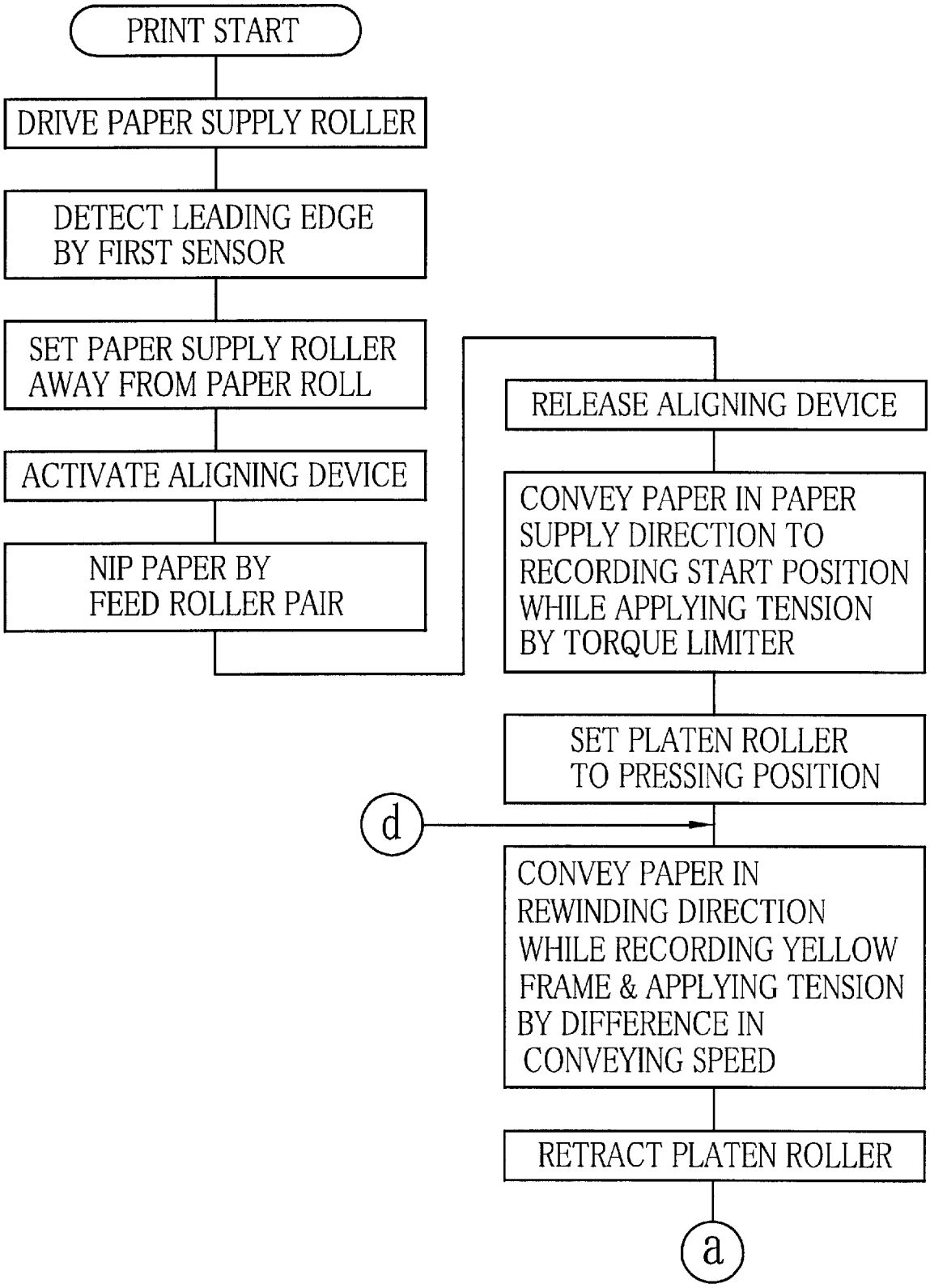
FIGS. 13A, 13B, 13C and 13D show a flowchart illustrating an overall operation of the thermosensitive color printer of the second embodiment.
Figure 13B:
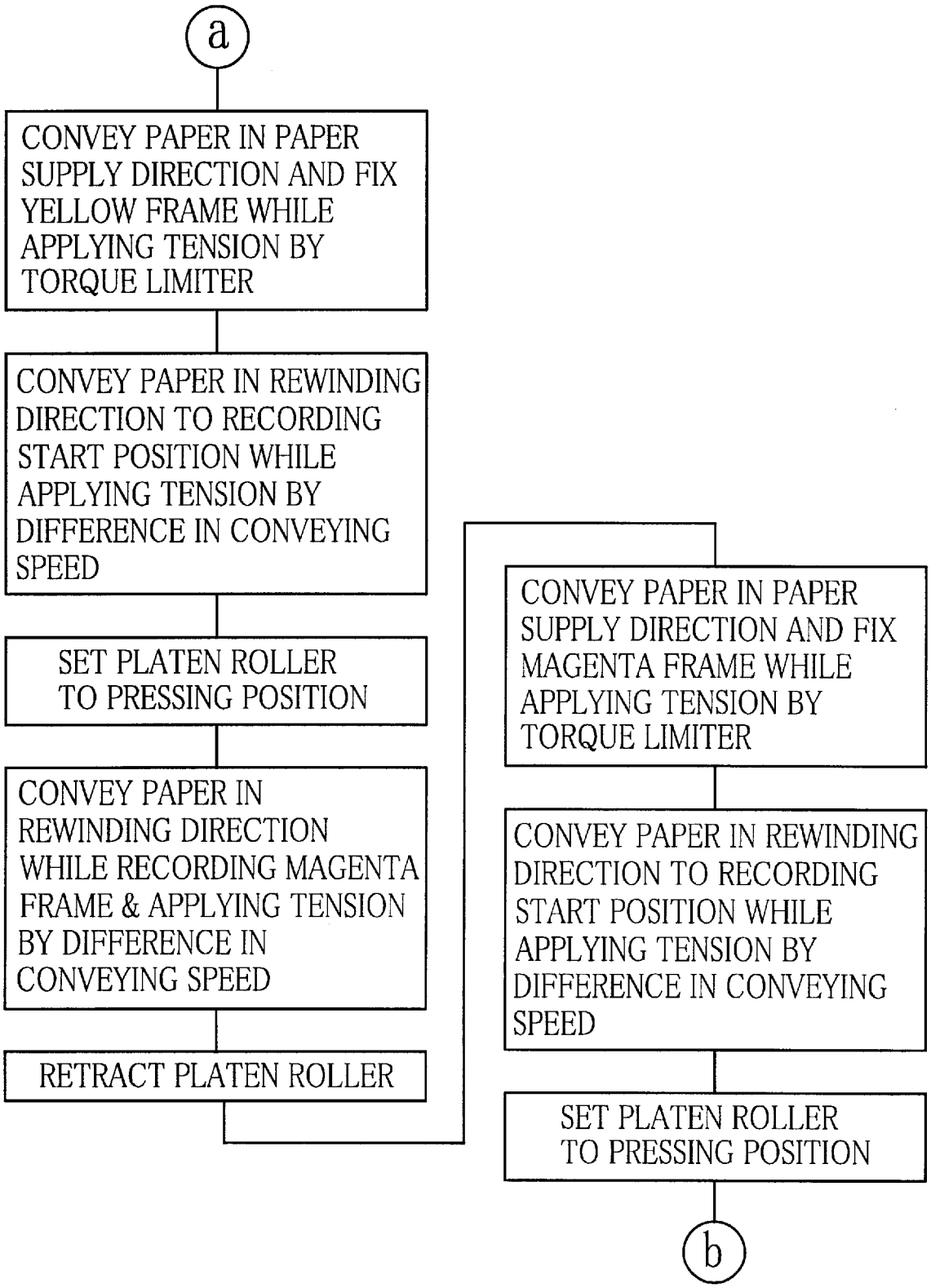
Figure 13C:
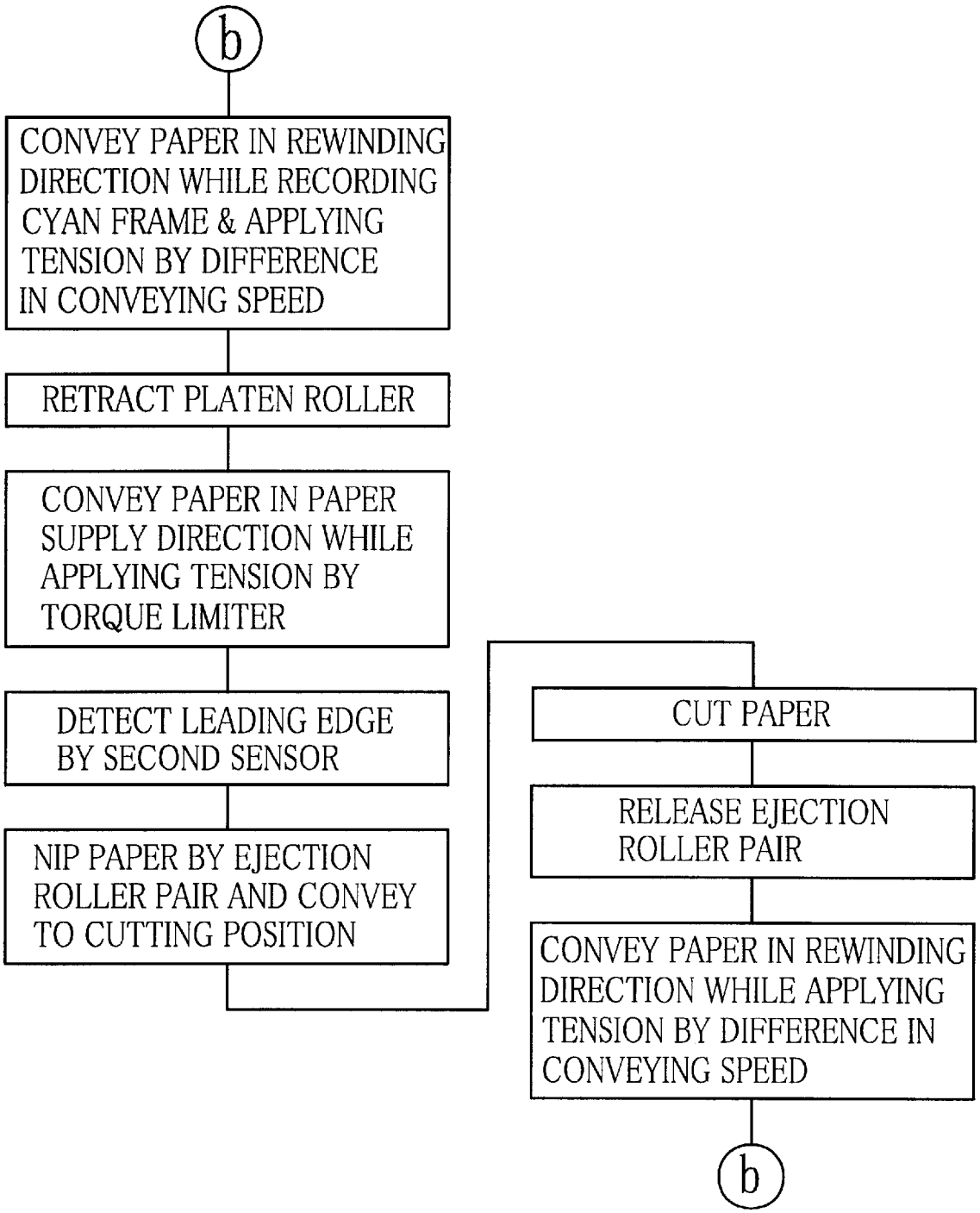
Figure 13D:
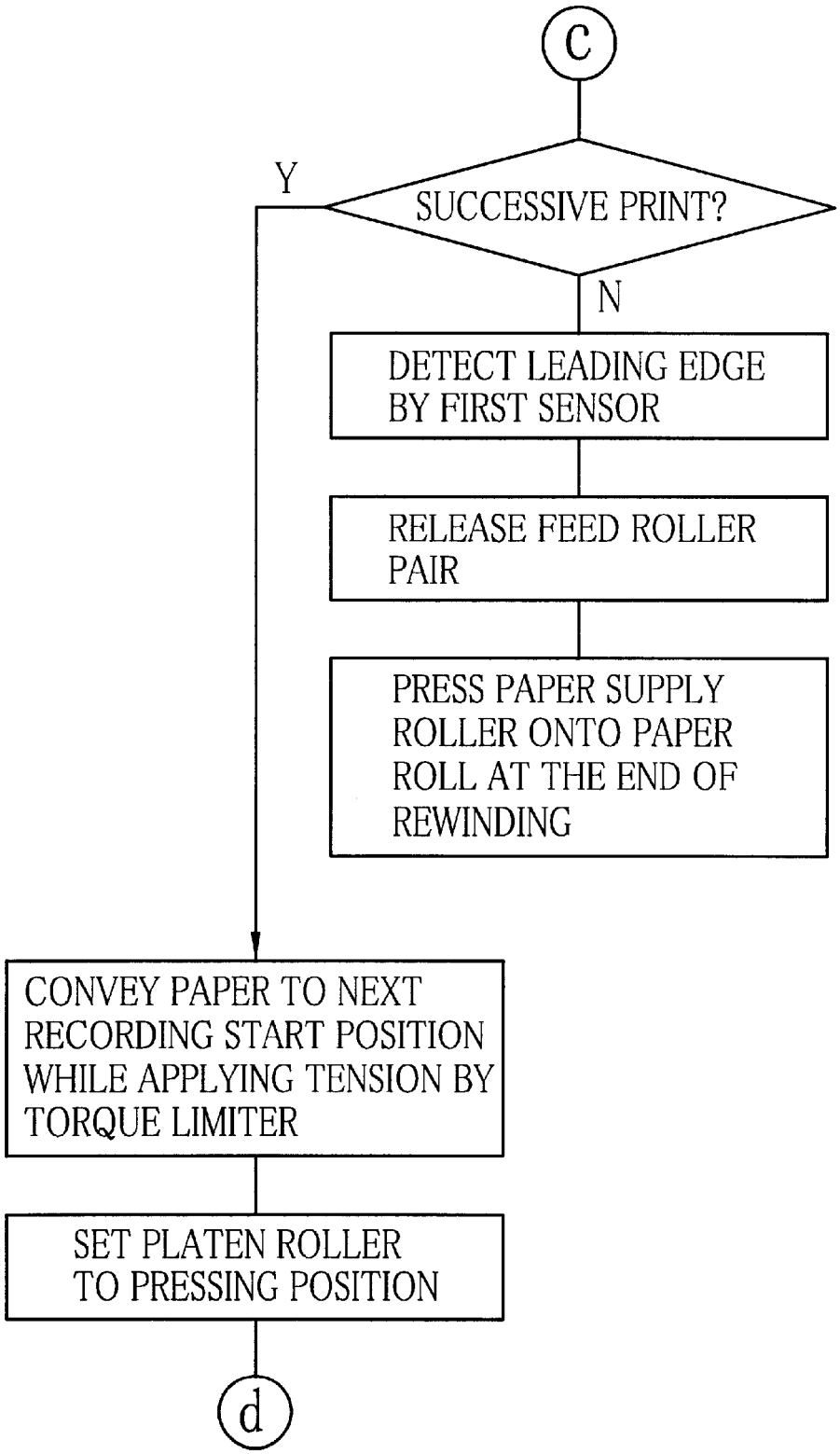

As shown in FIG. 12, a pair of paper holders 105 and 106 are attached to opposite end faces of the recording paper roll 81. The paper holders 105 and 106 have flanges 105*a* and 106*a* whose diameter is greater than a maximum external diameter of the recording paper roll 81. The paper holders 105 and 106 are each provided with a cylindrical force-fitting portion 107 that is force-fitted in either end of a spool 108 of the recording paper roll 81. Where the force-fitting portions 107 of the paper holders 105 and 106 are fitted in the ends of the spool 108, the flanges 105*a* and 106*a* confine the recording paper roll 81 as well as the thermosensitive color recording paper 80 in a widthwise direction of the thermosensitive color recording paper 80. Accordingly, deviation or inclination of the thermosensitive color recording paper 80 relative to a predetermined center line along the paper transport path is prevented while the thermosensitive color recording paper 80 is being fed out from or rewound onto the recording paper roll 81.

A gear 110 is provided on an outer end face of the paper holder 105. Through the gear 110, a back-tension applying device 111 is connected to the paper holder 105, for applying tension to the thermosensitive color recording paper 80 in a backward direction, i.e. the rewinding direction.

The back-tension applying device 111 is composed of a gear 112 interlocking with the gear 110, a torque limiter 113 and a gear 114 provided in coaxial with the gear 112, a gear 117 interlocking with the gear 114, a gear 116 interlocking with the gear 117, and a rewinding motor 115 for rotating the gear 116.

The torque limiter 113 of the back-tension applying device 111 applies a load on the gear 112 when the gear 112 is turned as the recording paper roll 81 and thus the paper holders 105 and 106 are caused to rotate in a counterclockwise direction in the drawings by the paper supply roller 83 as driven by the feed motor 83. As a result, the tension is applied to the thermosensitive color recording paper 80 in the rewinding direction while the thermosensitive color recording paper 80 is being fed out from the recording paper roll 81 and conveyed in the paper supply direction.

On rewinding the thermosensitive color recording paper 80 onto the recording paper roll 81, the rewinding motor 115 is driven to rotate the gear 116. The torque limiter 113 transmits the rotational movement of the gears 116 and 117 to the gear 112, so the paper holders 105 and 106 are caused to rotate in a clockwise direction in the drawings. The rewinding speed is predetermined to be higher than the conveying speed of the feed roller pair 89, so the thermosensitive color recording paper 80 is tensed between the recording paper roll 81 and the feed roller pair 89 as it is conveyed in the rewinding direction.

Reference is now made to FIGS. 13 to 16 for explaining the operation of the second embodiment having the above described configurations.

The thermosensitive color printer is supplied with image data from a personal computer, a video player, or a data recording medium, such as a card memory. The image data fed in the thermosensitive color printer is monitored as video images on a display device that is not shown but connected to the thermosensitive color printer. An image to print is selected from among the displayed images by operating a not-shown console of the thermosensitive color printer.

When a printer start button of the console is operated, the system controller of the thermosensitive color printer starts a printing process. In the printing process, the feed motor 84 is first driven to rotate the paper supply roller 83 in the paper supply direction, thereby the recording paper roll 81 is rotated in the counterclockwise direction in FIG. 11, feeding out a leading end of the thermosensitive color recording paper 80 into the paper transport path of the thermosensitive color printer.

The thermosensitive color recording paper 80 is thus fed into the aligning device 85 and the feed roller pair 89. At the start of printing process, the aligning device 85 is in an initial position where the guide members are set away from the side edges of the thermosensitive color recording paper 80, whereas the nip roller 88 of the feed roller pair 89 is in the retracted position away from the capstan roller 87. So the thermosensitive color recording paper 80 is conveyed smoothly through the aligning device 85 and the feed roller pair 89.

When the leading edge of the thermosensitive color recording paper 80 is moved past the feed roller pair 89, the first sensor 103 detects the leading edge of the recording paper 80 and outputs a detection signal to the system controller. Then the system controller stops the feed motor 84 and thus stops feeding out the thermosensitive color recording paper 80, and also sets the paper supply roller 83 away from the recording paper roll 81 through a not-shown shift mechanism.

Next, the aligning device 85 is driven to push the opposite side edges of the thermosensitive color recording paper 80 to correct the position of the thermosensitive color recording paper 80 if it is skewed or deviates relative to the center line. After the thermosensitive color recording paper 80 is aligned in this way, the nip roller 88 of the feed roller pair 89 is moved to the pressing position to nip the thermosensitive color recording paper 80 between the nip roller 88 and the capstan roller 87, so the thermosensitive color recording paper 80 maintains the corrected position. Thereafter, the guide members of the aligning device 85 are moved to the retracted position away from the thermosensitive color recording paper 80.

After the aligning, the system controller drives the feed motor 84 to rotate the feed roller pair 89 to convey the thermosensitive color recording paper 80 further in the paper supply direction. Since the torque limiter 113 applies the load on the recording paper roll 81 as rotating counterclockwise to convey the thermosensitive color recording paper 80 in the paper supply direction, the thermosensitive color recording paper 80 is tensed between the feed roller pair 89 and the recording paper roll 81. The tension stabilizes the conveying movement of the thermosensitive color recording paper 80, and thus prevents the thermosensitive color recording paper 80 from being skewed or deviating from the center.

When a recording start position of an image recording area on the thermosensitive color recording paper 80 reaches the heating element array 91*a* of the thermal head 91, the feed roller pair 89 stops conveying the thermosensitive color recording paper 80. To measure the conveyed amount of the thermosensitive color recording paper 80, rotational amount of the nip roller 88 is detected through an encoder. While the thermosensitive color recording paper 80 stops in this position, the platen roller 92 is moved to the pressing position to press the thermosensitive color recording paper 80 onto the heating element array 91*a* of the thermal head 91. Then the feed motor 84 is driven to rotate the feed roller pair 89 to convey the thermosensitive color recording paper 80 in the rewinding direction. Simultaneously, the heating element array 91*a* is heated to record a yellow frame of a full-color image on the yellow coloring layer of the thermosensitive color recording paper 80, line after line in synchronism with the movement of the thermosensitive color recording paper 80 in the rewinding direction.

To convey the thermosensitive color recording paper 80 in the rewinding direction, the rewinding motor 115 is also activated to rotate the recording paper roll 81 in the clockwise direction in FIG. 11 to rewind the thermosensitive color recording paper 80 onto the outer periphery of the recording paper roll 81. Since the rotational speed of the recording paper roll 81 is predetermined such that the thermosensitive color recording paper 80 is rewound onto the recording paper roll 81 at a slightly higher speed than the conveying speed of the thermosensitive color recording paper 80 through the feed roller pair 89, the thermosensitive color recording paper 80 is tensed between the recording paper roll 81 and the feed roller pair 89 in the rewinding direction. Accordingly, also in the rewinding direction, the thermosensitive color recording paper 80 is conveyed stably and prevented from being skewed or deviating relative to the center line.

In addition, since the thermosensitive color recording paper 80 as being rewound onto the recording paper roll 81 is confined in the widthwise direction by the flanges 105*a* and 106*a* of the paper holders 105 and 106, the side edges of the thermosensitive color recording paper 80 are aligned with the end faces of the recording paper roll 81, so the thermosensitive color recording paper 80 is neatly rewound onto the recording paper roll 81.

After the thermal recording of the yellow frame is completed, the feed roller pair 89 stops conveying the thermosensitive color recording paper 80, and the platen roller 92 is removed away from the thermal head 91. Then, the feed roller pair 89 starts conveying the thermosensitive color recording paper 80 in the paper supply direction again. Simultaneously, the yellow fixing device 94 is turned on for fixing the yellow coloring layer in the image recording area optically. Since the torque limiter 113 applies the tension to the thermosensitive color recording paper 80 in the rewinding direction while the thermosensitive color recording paper 80 is conveyed in the paper supply direction for the yellow fixing, the thermosensitive color recording paper 80 is prevented from being skewed or deviating relative to the center line also during the yellow fixing.

When the yellow coloring layer inside the image recording area is entirely fixed, the feed roller pair 89 is rotated to convey the thermosensitive color recording paper 80 in the rewinding direction. During this movement of the thermosensitive color recording paper 80 in the rewinding direction, the back-tension applying device 111 applies the tension to the thermosensitive color recording paper 80 between the recording paper roll 81 and the feed roller pair 89 because of the difference between the rewinding speed by the rewinding motor 115 and the conveying speed of the feed roller pair 89 in the rewinding direction. Also the paper holders 105 and 106 align the thermosensitive color recording paper 80 with the recording paper roll 81 during the rewinding, so the thermosensitive color recording paper 80 is prevented from being skewed or deviating from the center.

When the recording start position of the image recording area comes face to face with the heating element array 91*a* of the thermal head 91, the feed roller pair 89 stops, and the platen roller 92 is moved to the pressing position to press the thermosensitive color recording paper 80 onto the heating element array 91*a* of the thermal head 91. Then the feed roller pair 89 restarts conveying the thermosensitive color recording paper 80 in the rewinding direction. Simultaneously, the heating element array 91*a* is heated to record a magenta frame of the full-color image line after line on the magenta coloring layer of the thermosensitive color recording paper 80. During the magenta recording, the thermosensitive color recording paper 80 is tensed between the recording paper roll 81 and the feed roller pair 89 by the back-tension applying device 111, and is aligned with the recording paper roll 81 by the paper holders 105 and 106, so the thermosensitive color recording paper 80 is prevented from being skewed or deviating from the center.

After the magenta frame is entirely recorded, the feed roller pair 89 stops conveying the thermosensitive color recording paper 80, and the 92 is moved to the retracted position. Then, the feed roller pair 89 starts conveying the thermosensitive color recording paper 80 in the paper supply direction, while the magenta fixing device 95 optically fixes the magenta coloring layer inside the image recording area. Since the thermosensitive color recording paper 80 is tensed between the recording paper roll 81 and 89 by the torque limiter 113 of the back-tension applying device 111 during the magenta fixing, the thermosensitive color recording paper 80 is prevented from being skewed or deviating from the center.

When the magenta coloring layer inside the image recording area is entirely fixed, the feed roller pair 89 is rotated to convey the thermosensitive color recording paper 80 in the rewinding direction. During the movement of the thermosensitive color recording paper 80 in the rewinding direction, the back-tension applying device 111 applies the tension to the thermosensitive color recording paper 80 between the recording paper roll 81 and the feed roller pair 89, so the thermosensitive color recording paper 80 is prevented from being skewed or deviating from the center. When the recording start position of the image recording area comes face to face with the heating element array 91*a*, the feed roller pair 89 stops, and the platen roller 92 is moved to the pressing position. Then the feed roller pair 89 restarts conveying the thermosensitive color recording paper 80 in the rewinding direction. Simultaneously, the heating element array 91*a* is heated to record a cyan frame of the full-color image line after line on the magenta coloring layer of the thermosensitive color recording paper 80. During the cyan recording, the thermosensitive color recording paper 80 is tensed between the recording paper roll 81 and the feed roller pair 89 by the back-tension applying device 111, and is aligned with the recording paper roll 81 by the paper holders 105 and 106, so the thermosensitive color recording paper 80 is prevented from being skewed or deviating from the center.

After the cyan frame is entirely recorded, the feed roller pair 89 stops conveying the thermosensitive color recording paper 80, and the 92 is moved to the retracted position. Then, the feed roller pair 89 starts conveying the thermosensitive color recording paper 80 in the paper supply direction. When the leading edge of the thermosensitive color recording paper 80 is detected by the second sensor 104, the system controller stops conveying the thermosensitive color recording paper 80, and moves the nip roller 100 onto the capstan roller 99 of the ejection roller pair 97 to nip the thermosensitive color recording paper 80 between these rollers.

The ejection roller pair 97 conveys the thermosensitive color recording paper 80 toward the exit 101, and stops conveying when a cutting position of the thermosensitive color recording paper 80 is placed at the cutter 98. Since the conveying speed of the ejection roller pair 97 is slightly lower than that of the feed roller pair 89, the thermosensitive color recording paper 80 is conveyed to the cutting position by controlling the rotational amount of the ejection roller pair 97. Even while the thermosensitive color recording paper 80 is conveyed through the ejection roller pair 97, since the back-tension applying device 111 applies the tension to the thermosensitive color recording paper 80 between the feed roller pair 89 and the recording paper roll 81, the thermosensitive color recording paper 80 is prevented from being skewed or deviating from the center.

The cutter 98 cuts the thermosensitive color recording paper 80 into a sheet having the full-color image recorded thereon. The printed sheet is ejected through the exit 101 out of the thermosensitive color printer. Thereafter, the nip roller 100 of the ejection roller pair 97 is removed away from the capstan roller 99, and the thermosensitive color recording paper 80 is conveyed in the rewinding direction through the feed roller pair 89. Also during this rewinding, the thermosensitive color recording paper 80 is tensed because of the slightly higher rewinding speed by the rewinding motor 115 than the conveying speed through the feed roller pair 89, so the thermosensitive color recording paper 80 is prevented from being skewed or deviating from the center.

If successive printing is designated by the operator at the start of printing, the thermosensitive color recording paper 80 is conveyed in the rewinding direction till an end of a next image recording area is placed at the heating element array 91*a* of the thermal head 91. Thereafter, the thermosensitive color printer repeats the same printing operations as above. If successive printing is not designated, the feed roller pair 89 releases the thermosensitive color recording paper 80 when the first sensor 103 detects a leading edge of the thermosensitive color recording paper 80. Thereafter, the entire length of the thermosensitive color recording paper 80 is rewound onto the recording paper roll 81. At that time, the paper supply roller 83, while being pressed onto the outer convolution of the recording paper roll 81, prevents the recording paper roll 81 from unwinding.

Although the above embodiments are thermosensitive color printers, the present invention is applicable to thermal transfer type printers, and any other types of printers. The present invention is also applicable to photocopiers.

Thus, the present invention is not to be limited to the above embodiment but, on the contrary, various modifications will be possible to those skilled in the art without departing from the scope of claims appended hereto.

What is claimed is:

1. A printer comprising:

a paper supply section for supplying a recording paper therefrom;

a feed roller pair for nipping and conveying said recording paper along a paper transport path;

a printing head for printing an image on said recording paper in synchronism with conveying movement of said recording paper; and an aligning device disposed in said paper transport path between said paper supply section and said printing head, for aligning said recording paper with said paper transport path, said aligning device comprising a pair of guide members placed so as to face side edges of said recording paper on said paper transport path so as to be able to pivot each on a perpendicular axis to a recording surface of said recording paper; a drive mechanism for shifting said guide members toward said side edges of said recording paper to push said side edges; and a stopping device for stopping said guide members at an aligning position as said guide members are shifted toward said side edges of said recording paper, wherein said recording paper is oriented parallel to said paper transport path as said side edges are confined by said guide members at said aligning position.

2. A printer as recited in claim 1, wherein said stopping device has a pair of stopping portions which said guide members come to contact with at said aligning position.

3. A printer as recited in claim 2, wherein a distance between said stopping portions is defined to be equal to a tolerable minimum width of said recording paper.

4. A printer as recited in one of claim 2, wherein said stopping portions of said stopping device are adjustable in position in a lateral direction to said paper transport path, as well as an angle relative to the parallel direction to said paper transport path.

5. A printer as recited in one of claims 1 to 4, wherein said aligning position is determined such that a center line of said recording paper is aligned with a center line of said paper transport path when said side edges are confined by said guide members at said aligning position.

6. A printer as recited in claim 1, wherein said paper transport path is gently curved in a section passing through said aligning device.

7. A printer as recited in claim 1, further comprising a pair of position keeping rollers disposed in said aligning device, wherein said position keeping rollers are set away from said recording paper while said aligning device is being driven, and nip said recording paper after said recording paper is aligned.

8. A printer as recited in claim 7, wherein said position keeping rollers are placed before said feed roller pair in a paper supply direction from said paper supply section toward said printing head, and convey said recording paper at a lower speed than said feed roller pair in said paper supply direction, and at a higher speed than said feed roller pair in a reverse direction to said paper supply direction, thereby to apply tension to said recording paper between said feed roller pair and said position keeping rollers.

9. A printer as recited in claim 1, wherein a continuous web of said recording paper is coiled into a roll and a pair of paper holders are securely attached to opposite end faces of said roll when said recording paper is loaded in said paper supply section.

10. A printer as recited in claim 9, wherein said paper holders have flanges which are brought into contact with said end faces of said roll, said flanges have a larger diameter than a maximum external diameter of said roll.

11. A printer as recited in claim 9, further comprising a back-tension applying device for applying tension to said recording paper between said paper supply section and said feed roller pair, said back-tension applying device being coupled to said roll through at least one of said paper holders.

12. A printer as recited in claim 11, wherein said back-tension applying device comprises a first tension applying mechanism for applying tension while said recording paper is being conveyed in a paper supply direction, and a second tension applying mechanism for applying tension while said recording paper is being conveyed in a rewinding detection reverse to said paper supply direction.

13. A printer as recited in claim 12, wherein said first tension applying mechanism comprises a torque limiter that applies a load on said roll as said roll rotates in a direction to feed out said recording paper.

14. A printer as recited in claim 12, wherein said second tension applying mechanism comprises a drive mechanism that drives said roll to rotate in a direction to rewind said recording paper at a higher speed than a conveying speed through said feed roller pair in said rewinding direction.

* * * * *